US010420453B2

(12) United States Patent
Sohn et al.

(10) Patent No.: US 10,420,453 B2
(45) Date of Patent: Sep. 24, 2019

(54) DISHWASHER AND METHOD OF CONTROLLING THE SAME

(71) Applicant: Samsung Electronics Co., Ltd., Suwon-si (KR)

(72) Inventors: Se Jin Sohn, Suwon-si (KR); Soon Bae Yang, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 805 days.

(21) Appl. No.: 14/663,575

(22) Filed: Mar. 20, 2015

(65) Prior Publication Data

US 2015/0265132 A1 Sep. 24, 2015

(30) Foreign Application Priority Data

Mar. 21, 2014 (KR) ..... 10-2014-0033495

(51) Int. Cl.
*A47L 15/42* (2006.01)
*A47L 15/46* (2006.01)
(Continued)

(52) U.S. Cl.
CPC ..... *A47L 15/46* (2013.01); *A47L 15/0049* (2013.01); *A47L 15/16* (2013.01); *A47L 15/4282* (2013.01);
(Continued)

(58) Field of Classification Search
CPC ..... A47L 15/4225; A47L 15/4259; A47L 2401/26; A47L 2501/05; A47L 15/0049; D06F 2212/06
See application file for complete search history.

(56) References Cited

U.S. PATENT DOCUMENTS 5,722,263 A * 3/1998 Tassotti ..... A47L 15/4244 134/57 D
6,363,563 B1 4/2002 Range et al.
(Continued)

FOREIGN PATENT DOCUMENTS

CN 1628595 6/2005
CN 1887195 1/2007
(Continued)

OTHER PUBLICATIONS

JP2012019874—Machine Translation (Year: 2012).*
(Continued)

*Primary Examiner* — Marc Lorenzi
(74) *Attorney, Agent, or Firm* — Staas & Halsey LLP

(57) ABSTRACT

A dishwasher includes a circulation pump that supplies water to nozzles; a drainage pump that discharges the water; a driving current supply unit that supplies a driving current to one of the circulation pump and the drainage pump; a controller that transmits driving control signals to the driving current supply unit; and a door opening detection unit that, if opening of a door is detected, transmits door opening detection signals to the controller and the driving current supply unit, wherein, if the door opening detection signals are received while the circulation pump operates, the driving current supply unit stops supply of the driving current to the circulation pump and supplies the driving current to the drainage pump.

14 Claims, 18 Drawing Sheets

(51) Int. Cl.
*A47L 15/00* (2006.01)
*A47L 15/16* (2006.01)

(52) U.S. Cl.
CPC ..... *A47L 2401/26* (2013.01); *A47L 2501/05* (2013.01); *A47L 2501/20* (2013.01)

(56) References Cited

U.S. PATENT DOCUMENTS

| | | | | |
|---|---|---|---|---|
| 2003/0205252 | A1* | 11/2003 | DeBoer | A47L 15/0086 134/57 DL |
| 2010/0176754 | A1 | 7/2010 | Navarra et al. | |
| 2010/0186787 | A1* | 7/2010 | Rosenbauer | A47L 15/4225 134/57 D |
| 2015/0214720 | A1* | 7/2015 | Ranasinghe | A47L 15/4259 361/42 |

FOREIGN PATENT DOCUMENTS

| | | |
|---|---|---|
| CN | 101347320 | 1/2009 |
| CN | 103061639 | 4/2013 |
| JP | 2012-19874 | 2/2012 |
| KR | 10-2004-0046047 | 6/2004 |
| KR | 10-2005-0074213 | 7/2005 |

OTHER PUBLICATIONS

European Decision on Grant dated Dec. 12, 2017 in European Patent Application No. 15159966.9.
Chinese Office Action dated Feb. 28, 2017 in Chinese Patent Application No. 201510127412.6
Chinese Notice of Allowance dated Sep. 12, 2017 in Chinese Patent Application No. 201510127412.6.

* cited by examiner

DISHWASHER AND METHOD OF CONTROLLING THE SAME

CROSS-REFERENCE TO RELATED APPLICATIONS

This application claims the priority benefit of Korean Patent Application No. 10-2014-0033495, filed on Mar. 21, 2014 in the Korean Intellectual Property Office, the disclosure of which is incorporated herein by reference.

BACKGROUND

1. Field

The following description relates to a dishwasher and a method of controlling the same, and more particularly, to a dishwasher that sequentially operates a circulation pump and a drainage pump and a method of controlling the same.

2. Description of the Related Art

In general, dishwashers are devices that wash dishes by spraying washing water with a high pressure toward dishes and generally undergo a washing operation and a rinsing operation. In the washing operation, the dishwashers spray washing water and simultaneously cause detergent to be supplied by a detergent supply unit so that washing of the dishes can be performed.

In general, a dishwasher includes a body in which a washing chamber is formed, a circulation pump that generates a washing water pressure, a dish basket that accommodates the dishes and is installed in a washing tub to advance and retreat, a plurality of nozzle assemblies that spray washing water toward the dish basket, a connection flow path that connects the circulation pump and the plurality of nozzle assemblies, and a valve assembly that selectively moves washing water to the plurality of nozzle assemblies from the circulation pump. The dishes are washed with the washing water sprayed by the nozzle assemblies. Also, after the washing operation is finished, the dishwasher discharges the washing water to the outside of the dishwasher through a drainage pump.

When a user opens a door of the dishwasher during the washing operation, the dishwasher stops an operation of the circulation pump and waits for an operation of the drainage pump so that the washing water used to wash the dishes may not be discharged to the outside of the door.

SUMMARY

Therefore, it is an aspect of the present disclosure to provide a dishwasher in which, when a user opens a door of the dishwasher during a washing operation, the dishwasher quickly stops an operation of a circulation pump and waits for an operation of a drainage pump, and a method of controlling the same.

Additional aspects of the disclosure will be set forth in part in the description which follows and, in part, will be obvious from the description, or may be learned by practice of the disclosure.

In accordance with an aspect of the present disclosure, a dishwasher includes: a circulation pump that supplies water to nozzles; a drainage pump that discharges the water; a driving current supply unit that supplies a driving current to one of the circulation pump and the drainage pump; a controller that transmits driving control signals to the driving current supply unit; and a door opening detection unit that detects opening of a door and, when opening of a door is detected, transmits door opening detection signals to the controller and the driving current supply unit, wherein, when the door opening detection signals are received while the driving current is supplied to the circulation pump, the driving current supply unit may stop supply of the driving current to the circulation pump and may supply the driving current to the drainage pump.

The driving current supply unit may include: a door signal receiver that receives the door opening detection signals from the door opening detection unit; an inverter that outputs the driving current; and a current distributor that distributes the driving current output by the inverter to one of the circulation pump and the drainage pump, wherein, when the door opening detection signals are received by the door signal receiver while the driving current is supplied to the circulation pump, the current distributor may stop transmitting of the driving current to the circulation pump and may transmit the driving current to the drainage pump.

The driving current supply unit may further include a first microprocessor that controls the inverter and the current distributor according to the driving control signals transmitted by the controller.

The current distributor may include a three-contact point switching circuit that connects the inverter to one of the circulation pump and the drainage pump according to a motor selection signal output by the first microprocessor.

When the door opening detection signals are received, the three-contact point switching circuit may connect the inverter and the drainage pump.

When the door opening detection signals are received, the first microprocessor may stop an operation of the inverter.

The three-contact point switching circuit may include: a three-contact point relay that connects the inverter to one of the circulation pump and the drainage pump; and a relay driving circuit that supplies a current to the three-contact point relay.

When the current is supplied to the three-contact point relay, the inverter may be connected to the circulation pump, and if supply of the current to the three-contact point relay is blocked, the inverter may be connected to the drainage pump.

When the door opening detection signals are received, the relay driving circuit may block supply of the current to the three-contact point relay.

When the door opening detection signals are not received, the relay driving circuit may supply the current to the three-contact point relay.

The controller may include a second microprocessor that outputs the driving control signals that cause one of the circulation pump and the drainage pump to operate according to a user's control instructions.

The current distributor may include a three-contact point switching circuit that connects the inverter to one of the circulation pump and the drainage pump according to the driving control signals output by the second microprocessor.

When the door opening detection signals are received, the three-contact point switching circuit may connect the inverter and the drainage pump.

When the door opening detection signals are received, the second microprocessor may stop an operation of the inverter.

The three-contact point switching circuit may include: a three-contact point relay that connects the inverter to one of the circulation pump and the drainage pump; and a relay driving circuit that supplies a current to the three-contact point relay.

In accordance with an aspect of the present disclosure, a method of controlling a dishwasher, including a driving current supply unit that supplies a driving current to one of a circulation pump and a drainage pump and a controller that transmits driving control signals to the driving current supply unit, includes: when a door opening of the dishwasher is detected, transmitting, by a door open detection unit, door opening detection signals to the driving current supply unit and the controller; when the door opening detection signals are received, stopping, by the driving current supply unit, supply of the driving current to the circulation pump and supplying, by the driving current supply unit, the driving current to the drainage pump; and when the door opening detection signals are received, stopping, by the controller, supply of the driving current to the circulation pump and the drainage pump.

The stopping of the supply, by the driving current supply unit, of the driving current to the circulation pump and the supplying of the driving current to the drainage pump may include: blocking connection between an inverter that outputs the driving current and the circulation pump; and connecting the inverter and the drainage pump.

The stopping of the supply, by the controller, of the driving current to the circulation pump and the drainage pump may include stopping an operation of the inverter that outputs the driving current.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
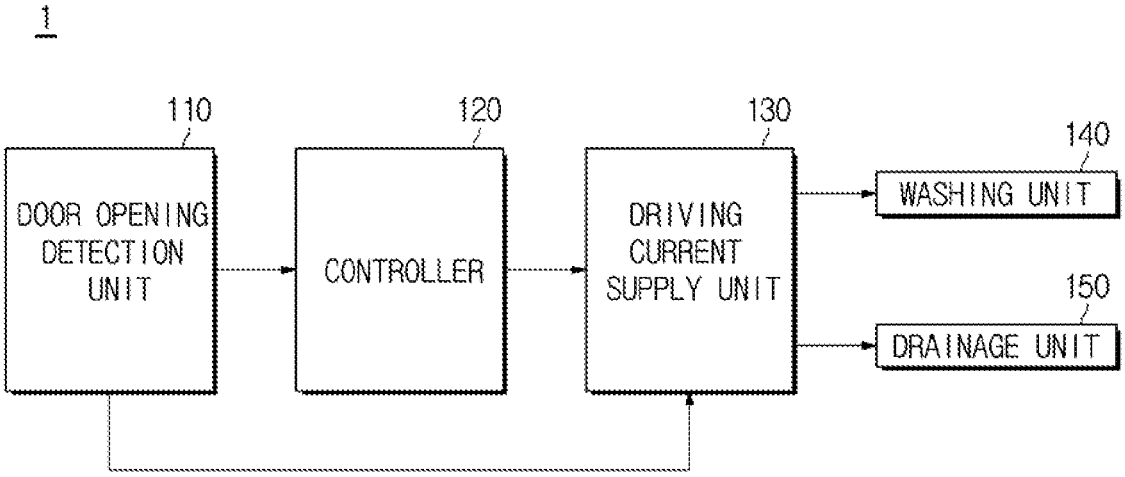
FIG. 1 is a schematic view of a configuration of a dishwasher according to an embodiment of the present disclosure.

Reference will now be made in detail to the embodiments, examples of which are illustrated in the accompanying drawings, wherein like reference numerals refer to like elements throughout. The embodiments are described below to explain the present disclosure by referring to the figures.

Embodiments described in the specification and configurations shown in the drawings of the specification are merely exemplary embodiments of the present disclosure, and there may be various modified examples that may replace the embodiments and the drawings of the specification at the time of filing an application of the present disclosure.

Hereinafter, an embodiment of the present disclosure will be described in detail with reference to the accompanying drawings.

Figure 2:
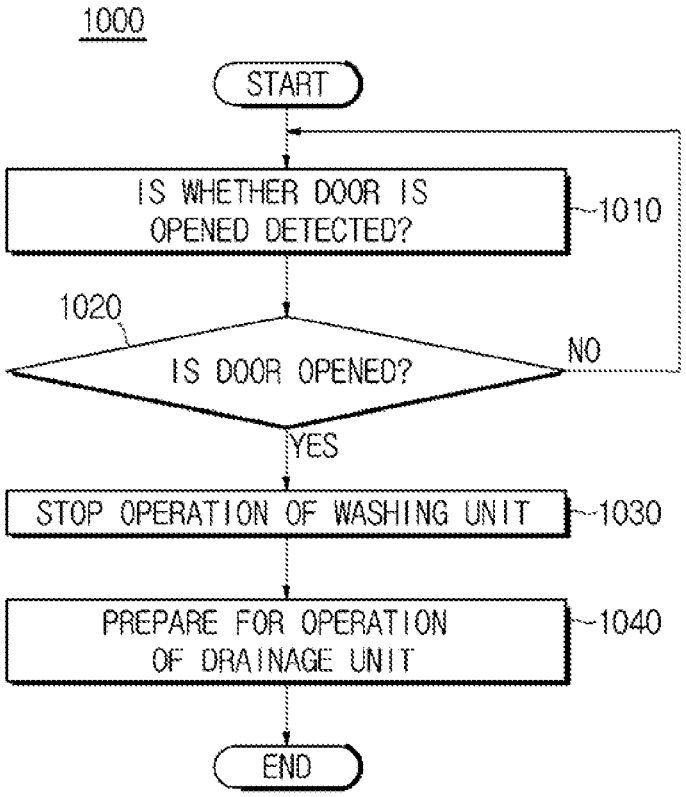
FIG. 2 is a schematic view of an operation of the dishwasher according to an embodiment of the present disclosure.

FIG. 1 is a schematic view of a configuration of a dishwasher according to an embodiment of the present disclosure, and FIG. 2 is a schematic view of an operation of the dishwasher according to an embodiment of the present disclosure.

A configuration and an operation of a dishwasher 1 according to an embodiment of the present disclosure will be briefly described with reference to FIGS. 1 and 2.

With respect to the configuration of the dishwasher 1, the dishwasher 1 includes a door opening detection unit 110 that detects whether a door is opened, a washing unit 140 that washes dishes accommodated in the dishwasher 1, a drainage unit 150 that discharges washing water to the outside of the dishwasher 1, a driving current supply unit 130 that supplies driving energy to one of the washing unit 140 and the drainage unit 150, and a controller 120 that controls the driving current supply unit 130 so that the washing unit 140 or the drainage unit 150 may operate depending on whether the door is opened.

The washing unit 140 circulates the washing water stored in the dishwasher 1, thereby washing the dishes accommodated in the dishwasher 1.

If washing of the dishes using the washing unit 140 is finished, the drainage unit 150 discharges the washing water stored in the dishwasher 1 to the outside of the dishwasher 1.

The door opening detection unit 110 detects whether the door is opened, and if opening of the door is detected, the door opening detection unit 110 transmits door opening detection signals corresponding to the door opening to the controller 120 and the driving current supply unit 130.

In detail, if the door of the dishwasher 1 is closed, the door opening detection unit 110 outputs door closing detection signals, and if the door of the dishwasher 1 is opened, the door opening detection unit 110 outputs the door opening detection signals.

The controller 120 controls the driving current supply unit 130 according to the door opening detection signals of the door opening detection unit 110 so that one of the washing unit 140 and the drainage unit 150 may operate. In detail, if the door opening detection signals are received, the controller 120 transmits control signals that cause the washing unit 140 to stop its operation and the drainage unit 150 to wait for its operation, to the driving current supply unit 130.

The driving current supply unit 130 supplies driving energy to one of the washing unit 140 and the drainage unit 150 according to the control signals of the controller 120 and the door opening detection signals of the door opening detection unit 110.

In particular, when the door opening detection signals are received from the door opening detection unit 110, the driving current supply unit 130 stops supplying of the driving energy to the washing unit 140 and prepares to supply the driving energy to the drainage unit 150.

An operation of the dishwasher 1 will now be briefly described. The dishwasher 1 performs a washing operation of washing the dishes and a rinsing operation of rinsing the dishes. Also, the dishwasher 1 may optionally perform a drying operation of drying the dishes.

Each of the washing operation and the rinsing operation includes a water supplying operation of supplying the washing water used to wash the dishes, a spraying operation of spraying the washing water toward the dishes, and a drainage operation of discharging the washing water after dish washing is finished.

During the water supplying operation, the dishwasher 1 receives the washing water from an external water supply source through a water supply unit (not shown), and during the spraying operation, the dishwasher 1 sprays the washing water toward the dishes using the washing unit 140. Also, during the drainage operation, the dishwasher 1 discharges the washing water stored in the dishwasher 1 using the drainage unit 150.

In particular, when a user opens the door of the dishwasher 1 during the spraying operation, the dishwasher 1 stops the operation of the washing unit 140 so that the washing water sprayed by the washing unit 140 may not spatter toward the user. Also, the dishwasher 1 waits for the operation of the drainage unit 150 so that the washing water stored in the dishwasher 1 may not overflow to the outside of the dishwasher 1 through the door.

A spraying stopping operation 1000 of the dishwasher 1 will now be briefly described. During the operation of the dishwasher 1, the dishwasher 1 detects whether the door is opened (operation 1010). As described above, the door opening detection unit 110 may detect whether the door is opened.

Subsequently, the dishwasher 1 determines whether the door is opened (operation 1020).

If opening of the door is detected, the door opening detection unit 110 transmits the door opening detection signals to the controller 120 and the driving current supply unit 130, and the controller 120 and the driving current supply unit 130 may determine whether the door is opened, based on the door opening detection signals of the door opening detection unit 110.

If opening of the door is not detected (NO of 1020), the dishwasher 1 continuously detects whether the door is opened, until opening of the door is detected.

If opening of the door is detected (YES of 1020), the dishwasher 1 stops the operation of the washing unit 140 (operation 1030).

In detail, if the door opening detection signals are received from the door opening detection unit 110, the controller 120 transmits the control signals that cause the washing unit 140 to stop its operation, to the driving current supply unit 130. Also, separately from the control signals transmitted from the controller 120, the driving current supply unit 130 stops supplying of the driving energy to the washing unit 140 once the door opening detection signals are received from the door opening detection unit 110.

In other words, the driving current supply unit 130 may stop supplying of the driving energy to the washing unit 140 prior to the control signals of the controller 120.

Subsequently, the dishwasher 1 waits for the operation of the drainage unit 150 (operation 1040).

In detail, if the door opening detection signals are received from the door opening detection unit 110, the controller 120 transmits the control signals that cause the drainage unit 150 to wait for its operation, to the driving current supply unit 130. Also, separately from the control signals transmitted from the controller 120, the driving current supply unit 130 prepares to supply the driving energy to the drainage unit 150 once the door opening detection signals are received from the door opening detection unit 110.

In this way, when the door is opened, the door opening detection signals are transmitted to both the controller 120 and the driving current supply unit 130 so that the dishwasher 1 according to an embodiment of the present disclosure may more quickly stop the operation of the washing unit 140 and may prepare for the operation of the drainage unit 150.

Hereinafter, each of configurations included in the dishwasher 1 according to an embodiment of the present disclosure will be described in detail.

Figure 3:
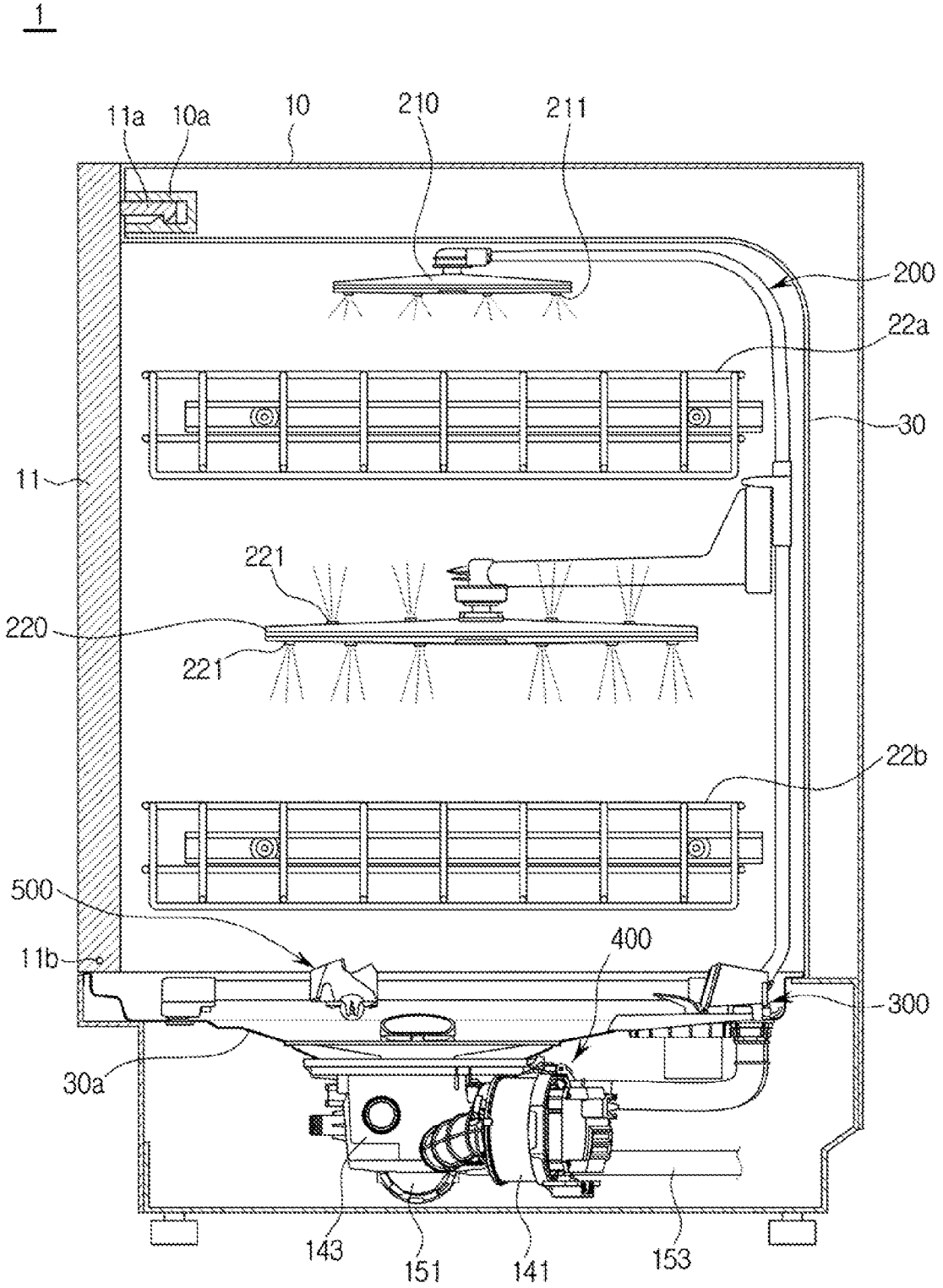
FIG. 3 is a side cross-sectional view of the dishwasher according to an embodiment of the present disclosure.
Figure 4:
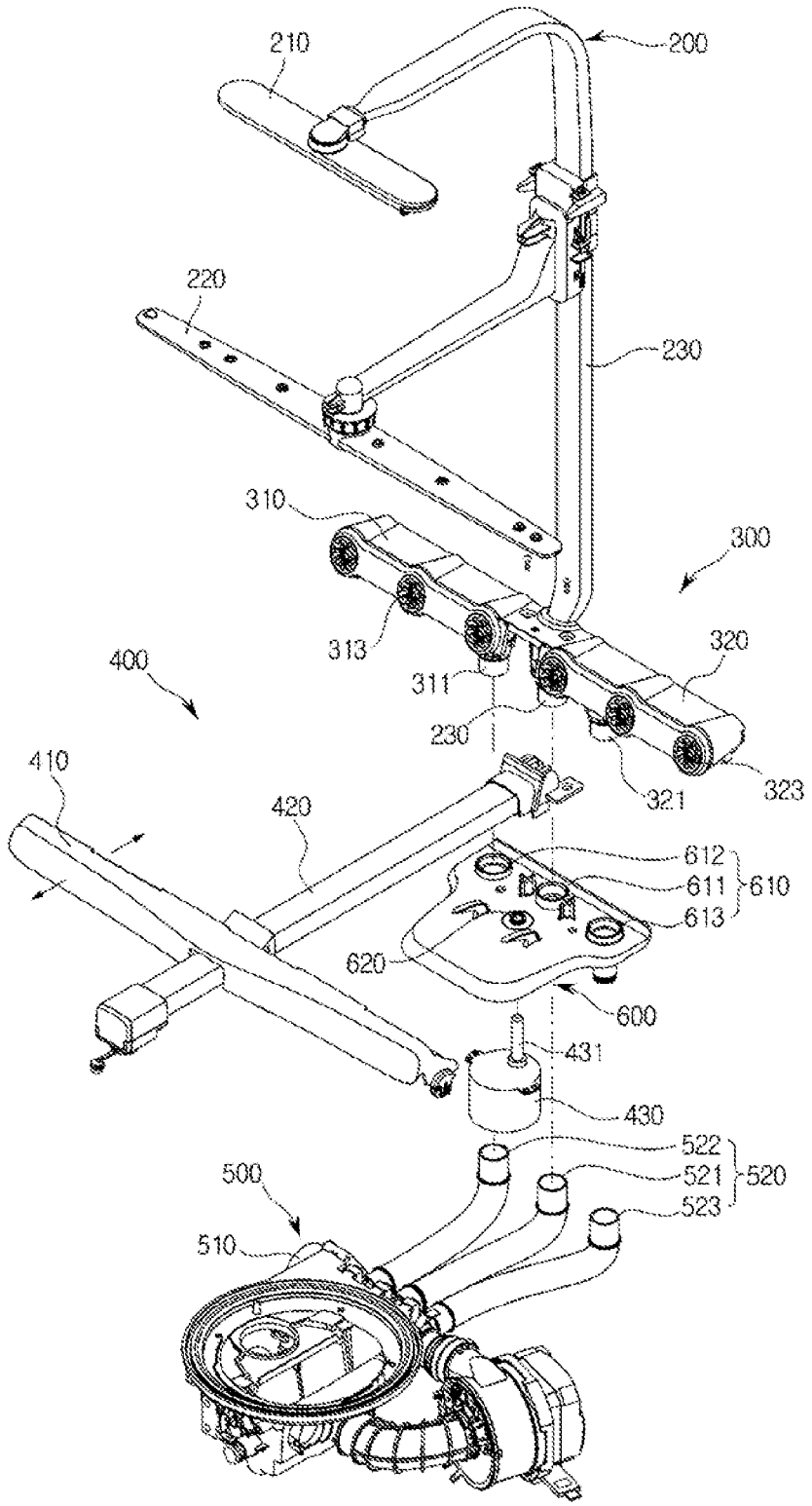
FIG. 4 is a view of a configuration of a washing unit included in the dishwasher according to an embodiment of the present disclosure.
Figure 5:
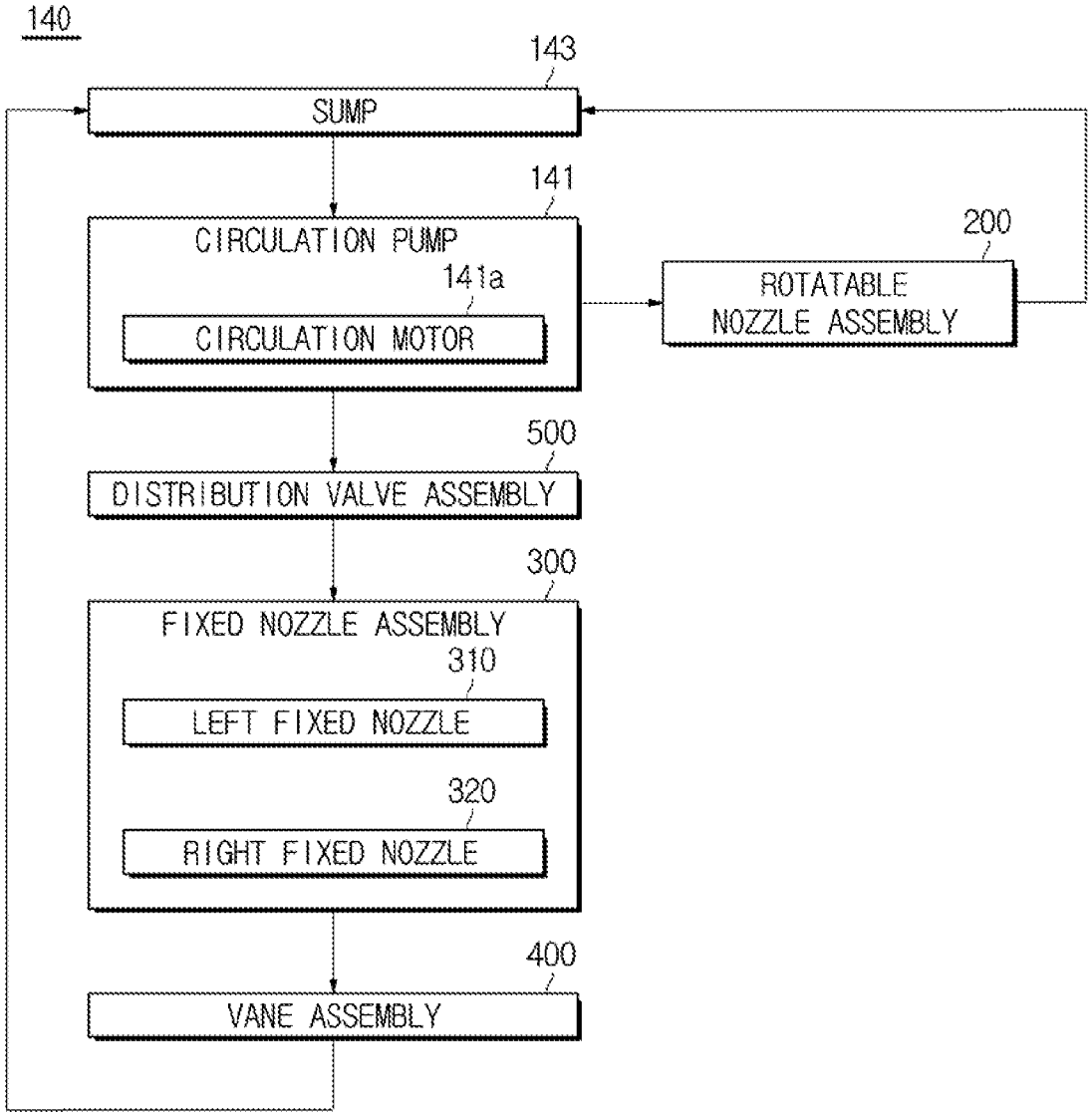
FIG. 5 is a view of a circulation operation of washing water using the washing unit included in the dishwasher according to an embodiment of the present disclosure.
Figure 6:
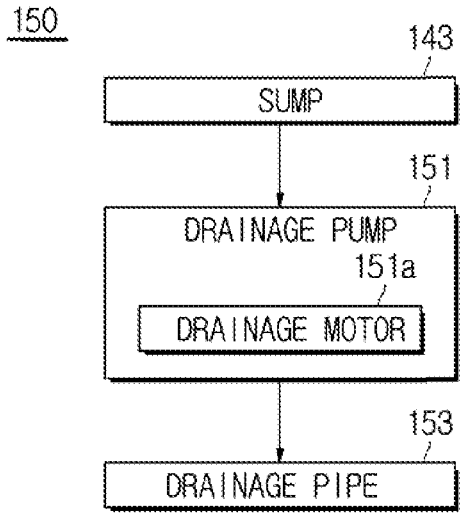
FIG. 6 is a view of a discharging operation of the washing water using a drainage unit included in the dishwasher according to an embodiment of the present disclosure.

FIG. 3 is a side cross-sectional view of the dishwasher according to an embodiment of the present disclosure, FIG. 4 is a view of a configuration of a washing unit included in the dishwasher according to an embodiment of the present disclosure, FIG. 5 is a view of a circulation operation of washing water using the washing unit included in the dishwasher according to an embodiment of the present disclosure, and FIG. 6 is a view of a discharging operation of the washing water using a drainage unit included in the dishwasher according to an embodiment of the present disclosure.

Referring to FIGS. 3 through 6, the dishwasher 1 according to an embodiment of the present disclosure includes a cabinet 10, a front side of which is opened, and a door 11 that opens/closes the front side of the cabinet 10.

A hinge 11*b*, that causes the door 11 to be rotatably coupled to the cabinet 10, is disposed at one side of the door 11, and a hook 11*a* for fixing the door 11 into the cabinet 10 is disposed at the other side of the door 11.

Also, a latch 10*a* coupled to the hook 11*a* in a position corresponding to the hook 11*a* of the door 11 is disposed in the cabinet 10.

By using the hinge 11*b*, the door 11 may be rotatably coupled to one side of the cabinet 10. The door 11 may close or open the front side of the cabinet 10.

Also, when the door 11 closes the front side of the cabinet 10, the hook 11*a* of the door 11 is inserted into the latch 10*a* of the cabinet 10, and the hook 11*a* is caught in a hanging portion disposed in the latch 10*a* so that the door 11 may be fixed into the cabinet 10. In other words, the door 11 is closed.

A tub 30, in which washing of the dishes is performed, is disposed in the cabinet 10, and baskets 22*a* and 22*b* for accommodating the dishes, the washing unit 140 that washes the dishes by spraying the washing water toward the dishes, and the drainage unit 150 that discharges the washing water if washing is finished, are disposed in the tub 30.

The tub 30 may have a shape of a box, the front of which is opened so that the dishes may be put into/taken out of the tub 30. Also, the front of the tub 30 may be opened/closed by the above-described door 11, and the tub 30 may include a bottom plate 30*a*.

The baskets 22*a* and 22*b* may be wire racks configured of wires so that the washing water may not be collected thereon but may pass through the baskets 22*a* and 22*b*. Also, the baskets 22*a* and 22*b* may be disposed to be attached to/detached from the tub 30.

The baskets 22*a* and 22*b* may include an upper basket 22*a* disposed at an upper portion of the tub 30 and a lower basket 22*b* disposed at a lower portion of the tub 30.

The washing unit 140 includes a rotatable nozzle assembly 200 and a fixed nozzle assembly 300 that spray the washing water, a sump 143 that stores the sprayed washing water, a circulation pump 141 that pumps the stored washing water toward the rotatable nozzle assembly 200 and the fixed nozzle assembly 300, a distribution valve assembly 500 that distributes the forcibly-transferred washing water to the rotatable nozzle assembly 200 and the fixed nozzle assembly 300, and a vane assembly 400 that reflects the washing water sprayed by the fixed nozzle assembly 300 toward the dishes while moving inside the tub 30.

The rotatable nozzle assembly 200 may wash the dishes by spraying the washing water under a high pressure. The rotatable nozzle assembly 200 includes an upper rotatable nozzle 210 disposed at an upper portion of the tub 30 and an intermediate rotatable nozzle 220 disposed in the center of the tub 30.

The rotatable nozzle assembly 200 receives the washing water through a central supply flow path 230 and sprays the washing water through rotatable spray holes 211 and 221 formed in the upper rotatable nozzle 210 and the intermediate rotatable nozzle 220, respectively.

Also, the rotatable nozzle assembly 200 may rotate due to a reaction caused by spraying of the washing water.

The fixed nozzle assembly 300 is disposed at a lower portion of the tub 30 not to move, unlike the rotatable nozzle assembly 200, and is fixed to one side of the tub 30.

For example, the fixed nozzle assembly 300 may be disposed to be adjacent to a rear side of the tub 30 and may spray the washing water toward the front of the tub 30. Thus, the washing water sprayed by the fixed nozzle assembly 300 may not be directly directed toward the dishes.

The fixed nozzle assembly 300 may include a left fixed nozzle 310 disposed on the left of the tub 30 and a right fixed nozzle 320 disposed on the right of the tub 30.

The left fixed nozzle 310 receives the washing water through a left supply flow path 311 and sprays the washing water through a left spray hole 313. Also, the right fixed nozzle 320 receives the washing water through a right supply flow path 321 and sprays the washing water through a right spray hole 323.

The washing water sprayed by the fixed nozzle assembly 300 may be reflected toward the dishes using the vane assembly 400 that will be described later.

For example, the fixed nozzle assembly 300 and the vane assembly 400 may be disposed below the lower basket 22*b* and may spray the washing water toward the front of the tub 30, and the vane assembly 400 may reflect the washing water sprayed by the fixed nozzle assembly 300 upward.

The vane assembly 400 may include a vane 410 that extends long in a left/right direction of the tub 30 to reflect the washing water sprayed by the fixed nozzle assembly 300, a vane guide 420 that guides movement of the vane 410, and a vane driving motor 430 that provides a movement force to the vane 410.

The vane guide 420 may be disposed to extend along a spray direction of the washing water sprayed by the fixed nozzle assembly 300, and the vane 410 may make a reciprocal motion along the vane guide 420. In other words, the vane 410 may make a reciprocal motion along the spray direction of the washing water sprayed by the fixed nozzle assembly 300.

The vane driving motor 430 provides the movement force through which the vane 410 may move along the vane guide 420, to the vane 410. In detail, the vane driving motor 430 generates a rotational force using electrical energy.

The rotational force generated by the vane driving motor 430 is converted into a linear movement force using a pulley and a pulley belt and is provided to the vane 410.

The vane driving motor 430 may be a bi-directional rotatable motor so that the vane 410 may make a reciprocal motion. However, the vane driving motor 430 is not limited to the bi-directional rotatable motor.

Also, a brushless direct current motor or a synchronous motor, a rotation speed of which may be controlled, or a direct current motor or an induction motor, rotation speed control of which is limited, may be may be used as the vane driving motor 430.

In this way, a linear spray structure including the fixed nozzle assembly 300 and the vane assembly 400 may wash all areas of the tub 30 without a blind spot.

The distribution valve assembly 500 distributes the washing water so that the rotatable nozzle assembly 200 and the fixed nozzle assembly 300 may spray the washing water independently of each other. Also, the distribution valve assembly 500 may distribute the washing water so that the left fixed nozzle 310 and the right fixed nozzle 320 included in the fixed nozzle assembly 300 may also spray the washing water independently of each other.

The distribution valve assembly 500 includes a distribution valve 510 that distributes the washing water to the rotatable nozzle assembly 200, the left fixed nozzle 310 and the right fixed nozzle 320, and a distribution flow path 520 that guides the washing water distributed by the distribution valve 510 toward the rotatable nozzle assembly 200, the left fixed nozzle 310 and the right fixed nozzle 320, respectively.

Also, the distribution flow path 520 may include a first distribution flow path 521 that guides the washing water distributed by the distribution valve 510 toward the rotatable nozzle assembly 200, a second distribution flow path 522 that guides the washing water distributed by the distribution valve 510 toward the left fixed nozzle 310, and a third distribution flow path 523 that guides the washing water distributed by the distribution valve 510 toward the right fixed nozzle 320.

The dishwasher 1 may divide the tub 30 into left and right sides and may wash the left and right sides of the tub 30 independently of each other using the distribution valve assembly 500 and the fixed nozzle assembly 300. Of course, the dishwasher 1 may not divide the tub 30 only into left and right sides but may subdivide the tub 30 as needed.

The sump 143 is disposed on the bottom plate 30*a* of the tub 30 and stores the washing water sprayed by the fixed nozzle assembly 300 or the rotatable nozzle assembly 200.

The circulation pump 141 includes a circulation motor 141*a* for pumping the washing water to the distribution valve assembly 500.

A brushless direct current motor or a synchronous motor, a rotation speed of which may be controlled, may be used as the circulation motor 141*a* so that the rotatable nozzle assembly 200 and the fixed nozzle assembly 300 may spray the washing water using various washing water spray forces.

Although it will be described later, the above-described driving current supply unit 130 may include an inverter to control the rotation speed of the brushless direct current motor or the synchronous motor.

In addition, the washing unit 140 may include a sealing cover 600 that is disposed on the bottom plate 30*a* of the tub 30 and connects an inside and an outside of the tub 30.

The above-described circulation pump 141 and distribution valve assembly 500 are disposed outside the tub 30, and the rotatable nozzle assembly 200 and the fixed nozzle assembly 300 are disposed in the tub 200. Also, the vane 410 and the vane guide 420 of the vane assembly 400 are disposed in the tub 30.

The sealing cover 600 connects a configuration disposed in the tub 30 and a configuration disposed outside the tub 30 and simultaneously prevents the washing water in the tub 30 from being discharged to the tub 30.

A flow path connection unit 610 that connects the supply flow paths 230, 311, and 321 disposed in the tub 30 and the distribution flow paths 521, 522, and 523 disposed outside the tub 30, is disposed in the sealing cover 600.

The flow path connection unit 610 includes a first flow path connection unit 611 that connects the central supply flow path 230 and the first distribution flow path 521, a second flow path connection unit 612 that connects the left supply flow path 311 and the second distribution flow path 522, and a third flow path connection unit 613 that connects the right supply flow path 321 and the third distribution flow path 523.

Also, a rotation shaft penetration unit 620 that penetrates a rotation shaft 431 of the vane driving motor 430, is disposed in the sealing cover 600 to transfer a movement force to the vane 410 disposed in the tub 30.

Circulation of the washing water using the washing unit 140 will be briefly described. First, the sump 143 stores the washing water supplied by the water supply unit (not shown).

During the washing operation, the circulation pump 141 pumps the washing water stored in the sump 143 to the distribution valve assembly 500 using the rotational force generated by the circulation motor 141*a*.

The washing water pumped by the circulation pump 141 to the distribution valve assembly 500 is optionally distributed to the rotatable nozzle assembly 200 and the fixed nozzle assembly 300 from the distribution valve assembly 500.

In this case, the distribution valve assembly 500 may distribute the washing water only to the rotatable nozzle assembly 200, may distribute the washing water to both the left and right fixed nozzles 310 and 320 included in the fixed nozzle assembly 300, or may distribute the washing water only to the left fixed nozzle 310 or the right fixed nozzle 320.

The washing water distributed to the rotatable nozzle assembly 200 is sprayed by the rotatable spray holes 211 and 221 toward the dishes and is used to wash the dishes. After the dishes are washed, the washing water is stored in the sump 143 again.

Also, the washing water distributed to the fixed nozzle assembly 300 is sprayed toward the vane 410 of the vane assembly 400. A proceeding path of the washing water sprayed toward the vane 410 is changed by the vane 410 so that the washing water may be directed toward the dishes and the washing water is used to wash the dishes. After the dishes are washed, the washing water is stored in the sump 143 again.

In this way, the washing water is used to wash the dishes while circulating in the sump 143, the circulation pump 141, the distribution valve assembly 500, the rotatable nozzle assembly 200 or the fixed nozzle assembly 300, and the vane assembly 400.

The drainage unit 150 includes a drainage pump 151 that pumps the washing water stored in the sump 143 to the outside of the dishwasher 1, and a drainage pipe 153 that guides the washing water pumped by the drainage pump 151 toward the outside of the dishwasher 1.

The drainage pump 151 includes a drainage motor 151*a* for pumping the washing water to the outside of the dishwasher 1 through the drainage pipe 153.

A brushless direct current motor or a synchronous motor may be used as the drainage motor 151*a* to reduce noise that occurs when the drainage motor 151*a* operates.

Discharging of the washing water using the drainage unit 150 will now be briefly described. First, the sump 143 stores the washing water sprayed by the rotatable nozzle assembly 200 and the fixed nozzle assembly 300.

If the washing operation is finished, the drainage pump 151 pumps the washing water stored in the sump 143 to the drainage pipe 153 using the rotational force generated by the drainage motor 151*a*.

The washing water pumped by the drainage pump 151 is discharged to the outside of the dishwasher 1 along the drainage pipe 153.

Figure 7:
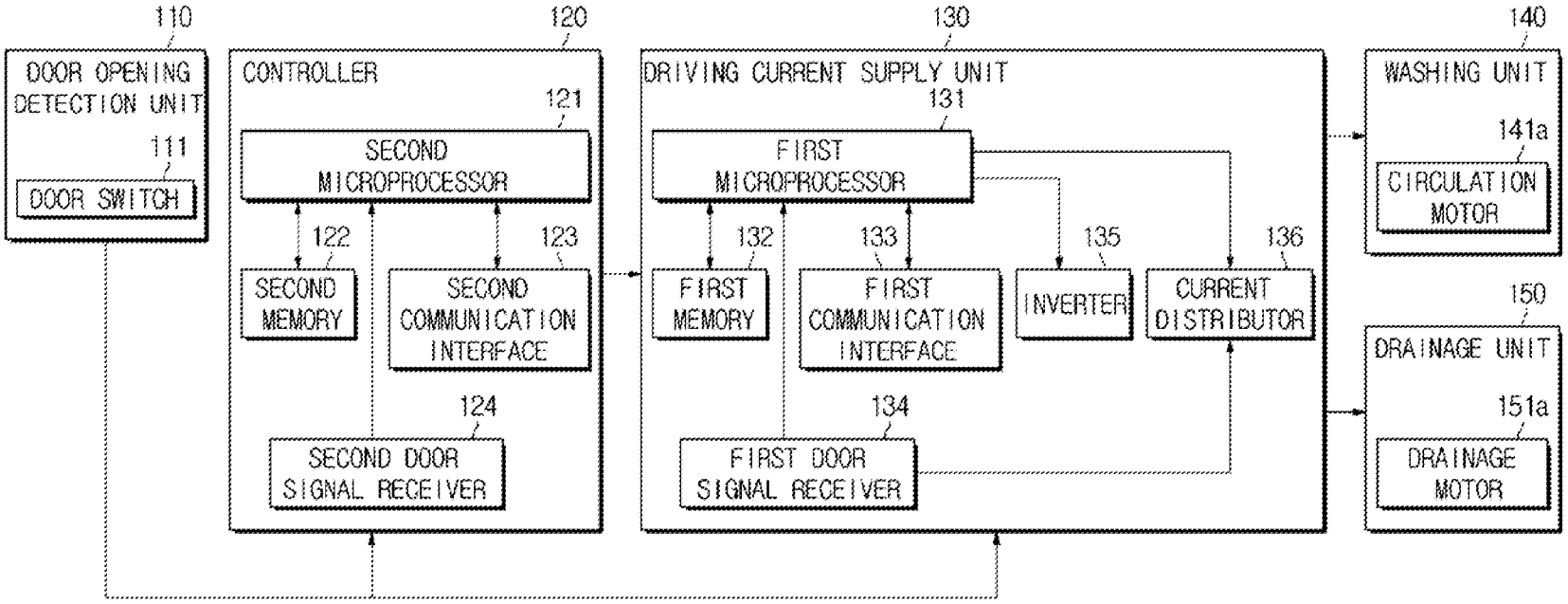
FIG. 7 is a view of a configuration of a controller and a driving current supply unit included in the dishwasher according to an embodiment of the present disclosure.
Figure 8:
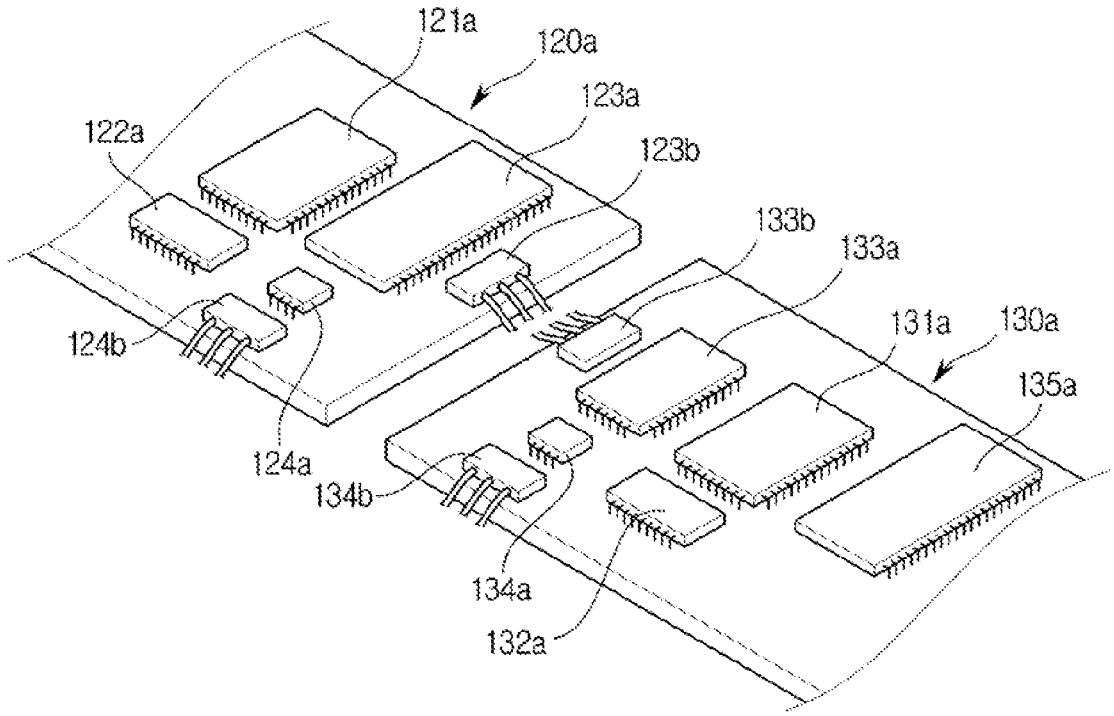
FIG. 8 is a view of an implementation example of the controller and the driving current supply unit included in the dishwasher according to an embodiment of the present disclosure.
Figure 9:
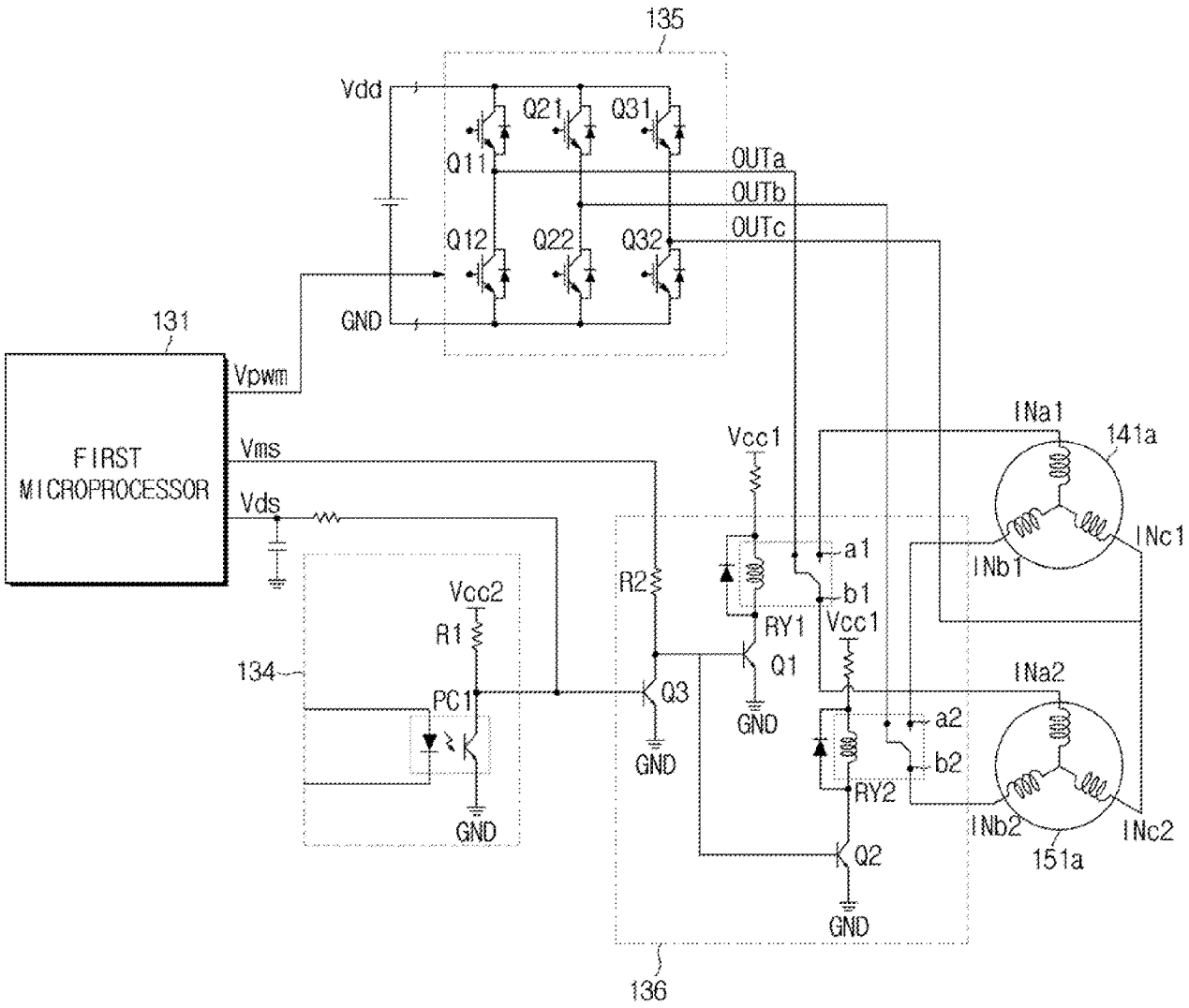
FIG. 9 is a view of an example of a circuit for implementing the driving current supply unit included in the dishwasher according to an embodiment of the present disclosure.

FIG. 7 is a view of a configuration of a controller and a driving current supply unit included in the dishwasher according to an embodiment of the present disclosure, and FIG. 8 is a view of an implementation example of the controller and the driving current supply unit included in the dishwasher according to an embodiment of the present disclosure, and FIG. 9 is a view of an example of a circuit for implementing the driving current supply unit included in the dishwasher according to an embodiment of the present disclosure.

As described above, the dishwasher 1 includes the door opening detection unit 110 that detects whether the door (see 11 of FIG. 3) is opened, the controller 120 that controls the overall operation of the dishwasher 1, the driving current supply unit 130 that supplies the driving energy to the washing unit 140 and the drainage unit 150, the washing unit 140 that washes the dishes by spraying the washing water, and the drainage unit 150 that discharges the washing water if washing of the dishes is finished.

The washing unit 140 and the drainage unit 150 have been described above and thus, a detailed description thereof will be omitted.

The door opening detection unit 110 includes a door switch 111.

For example, the door switch 111 may be disposed in the latch (see 10*a* of FIG. 3) of the cabinet (see 10 of FIG. 3) and outputs different electrical signals depending on whether the door (see 11 of FIG. 3) is opened/closed.

For example, if the door 11 is closed, the door switch 111 outputs detection signals at a "high" level, for example, voltage signals of 12 V, and if the door 11 is opened, the door switch 111 outputs detection signals at a "low" level, for example, voltage signals of 0 V.

Also, the door detection signals output by the door switch 111 are transmitted to the controller 120 and the driving current supply unit 130.

If the door 11 is closed, the door opening detection unit 110 may output door closing detection signals, for example, detection signals at a "high" level, and if the door 11 is opened, the door opening detection unit 110 may output door opening detection signals, for example, detection signals at a "low" level.

The controller 120 includes a second memory 122, a second communication interface 123, a second door signal receiver 124, and a second microprocessor 121.

The second memory 122 stores a program and data for controlling the operation of the dishwasher 1 and temporary data that is generated during the operation of the dishwasher 1.

In detail, the second memory 122 may include a nonvolatile memory, such as a read only memory (ROM), an erasable programmable read only memory (EPROM), an electrically erasable programmable read only memory (EEPROM), or a flash memory for permanently storing the program and the data for controlling the operation of the dishwasher 1, and a volatile memory, such as a dynamic random access memory (DRAM) or a static random access memory (SRAM) for temporarily storing data that is generated while the operation of the dishwasher 1 is controlled.

The second memory 122 may be implemented with a separate memory chip 122*a*, as illustrated in FIG. 8. However, embodiments of the present disclosure are not limited thereto. The second memory 122 may be integrated with the second microprocessor 121 and the second communication interface 123 and may also be implemented with a system-on-chip (SOC).

The second communication interface 123 performs communication with the driving current supply unit 130.

In detail, the second communication interface 123 modulates the data transmitted by the second microprocessor 121 to the driving current supply unit 130 into communication signals and transmits the modulated communication signals to the driving current supply unit 130. Also, the second communication interface 123 receives the communication signals transmitted by the driving current supply unit 130, restores data from the received communication signals, and transmits the restored data to the second microprocessor 121.

For example, the second communication interface 123 may include a universal asynchronous receiver/transmitter (UART) that transmits the data in an asynchronous manner. Also, when the second communication interface 123 includes the UART, the second communication interface 123 may receive/transmit signals from/to the driving current supply unit 130 using a communication protocol, such as recommended standard-232 (RS-232), RS-422, or RS-485.

The second communication interface 123 may be implemented with a separate communication chip 123*a* and a separate communication port 123*b*, as illustrated in FIG. 8. However, embodiments of the present disclosure are not limited thereto. The second communication interface 123 may be integrated with the second microprocessor 121 and the second memory 122 and may be implemented with a single system chip, and the separate communication port 123*b* may also be disposed in the second communication interface 123.

The second door signal receiver 124 receives the door closing detection signals and the door opening detection signals transmitted by the door opening detection unit 110.

In detail, the second door signal receiver 124 receives the door closing detection signals and the door opening detection signals transmitted by the door opening detection unit 110, restores data from the received door closing detection signals and door opening detection signals, and transmits the restored data to the second microprocessor 121.

For example, the second door signal receiver 124 may include a photocoupler for restoring the door detection signals transmitted by the door opening detection unit 110 into the data that may be identified by the second microprocessor 121.

Also, the second door signal receiver 124 may be implemented with a separate photocoupler chip 124*a* and a separate communication port 124*b*, as illustrated in FIG. 8.

The second microprocessor 121 performs a data processing operation for controlling each of the configurations included in the dishwasher 1 based on the user's control instructions, the program and the data stored in the second memory 122, the data received by the second communication interface 123, and the data received by the second door signal receiver 124.

For example, while the spraying operation is performed, the second microprocessor 121 determines the rotation speed of the circulation motor 141*a* and transmits rotation speed data to the second communication interface 123 to transmit the determined rotation speed to the driving current supply unit 130.

As an example, while the drainage operation is performed, the second microprocessor 121 determines the rotation speed of the drainage motor 151*a* and transmits the rotation speed data to the second communication interface 123 to transmit the determined rotation speed to the driving current supply unit 130.

Also, if the door opening detection signals are received by the second door signal receiver 124, the second microprocessor 121 transmits control signals to the second communication interface 123 to transmit the control signals that cause the circulation motor 141*a* to stop its operation and the drainage motor 151*a* to wait for its driving to the driving current supply unit 130.

The second microprocessor 121 may be implemented with a separate microprocessor chip 121*a*, as illustrated in FIG. 8. However, embodiments of the present disclosure are not limited thereto. The second microprocessor 121 may be integrated with the second memory 122 and the second communication interface 123 and may also be implemented with the single system chip.

The controller 120 controls each of the configurations included in the dishwasher 1 according to the user's control instructions.

For example, during the washing operation, the controller 120 performs the spraying operation by controlling the driving current supply unit 130 so that the washing unit 140 may spray the washing water toward the dishes, and if the spraying operation is finished, the controller 120 performs the drainage operation by controlling the driving current supply unit 130 so that the drainage unit 150 may discharge the washing water.

Also, if, during the spraying operation, the door opening detection signals are received from the door opening detection unit 110, the controller 120 may control the driving current supply unit 130 so that the washing unit 140 may stop washing water spraying and the drainage unit 150 may wait for washing water discharging.

Also, the controller 120 may be implemented with a printed circuit board (PCB) 120*a* on which a plurality of semiconductor devices are mounted.

For example, as illustrated in FIG. 8, the controller 120 may be implemented with the PCB 120*a* on which the microprocessor chip 121*a*, the memory chip 122*a*, the communication chip 123*a*, the photocoupler chip 124*a*, and the communication port 124*b* are mounted.

However, embodiments of the present disclosure are not limited thereto. As described above, the controller 120 may also be implemented with a PCB on which the single system chip in which the second microprocessor 121, the second memory 122 and the second communication interface 123 are integrated with each other, and the photocoupler chip 124*a* and the communication port 124*b* are mounted.

The driving current supply unit 130 includes a first memory 132, a first communication interface 133, a first door signal receiver 134, an inverter 135, a current distributor 136, and a first microprocessor 131.

The first memory 132 stores the program and the data for controlling operations of the circulation motor 141*a* of the washing unit 140 and the drainage motor 151*a* of the drainage unit 150 and temporary data generated while the circulation motor 141*a* and the drainage motor 151*a* are controlled.

In detail, the first memory 132 may include a nonvolatile memory, such as a ROM, an EPROM, an EEPROM, or a flash memory for permanently storing the program and the data for controlling the operations of the circulation motor 141*a* and the drainage motor 151*a*, and a volatile memory, such as a DRAM or an SRAM for temporarily storing data that is generated while the circulation motor 141*a* and the drainage motor 151*a* are controlled.

The first memory 132 may be implemented with a separate memory chip 132*a*, as illustrated in FIG. 8. However, embodiments of the present disclosure are not limited thereto. The first memory 132 may also be integrated with the first microprocessor 131 and the first communication interface 133 and may also be implemented with an SOC.

The first communication interface 133 performs communication with the controller 120.

In detail, the first communication interface 133 modulates the data transmitted by the first microprocessor 131 to the controller 120 into communication signals and transmits the modulated communication signals to the controller 120. Also, the first communication interface 133 receives the communication signals transmitted by the controller 120, restores data from the received communication signals, and transmits the restored data to the first microprocessor 131.

For example, the first communication interface 133 may include a UART that transmits the data in an asynchronous manner. Also, when the first communication interface 133 includes the UART, the first communication interface 133 may receive/transmit signals from/to the controller 120 using a communication protocol, such as recommended standard-232 (RS-232), RS-422, or RS-485.

The first communication interface 133 may be implemented with a separate communication chip 133*a* and a separate communication port 133*b*, as illustrated in FIG. 8. However, embodiments of the present disclosure are not limited thereto. The first communication interface 133 may be integrated with the first microprocessor 131 and the first memory 132 and may be implemented with a single system chip, and the separate communication port 133*b* may also be disposed in the first communication interface 133.

The first door signal receiver 134 receives the door closing detection signals and the door opening detection signals transmitted by the door opening detection unit 110.

In detail, the first door signal receiver 134 receives the door closing detection signals and the door opening detection signals transmitted by the door opening detection unit 110, restores data from the received door closing detection signals and door opening detection signals, and transmits the restored data to the first microprocessor 131 and the current distributor 136.

For example, the first door signal receiver 134 may include a photocoupler PC1 for restoring the door detection signals transmitted by the door opening detection unit 110 into the data that may be identified by the first microprocessor 131, as illustrated in FIG. 9.

Also, the first door signal receiver 134 may be implemented with a separate photocoupler chip 134*a*, as illustrated in FIG. 8.

The inverter 135 modulates a current of a direct current power supply Vdd according to the control signals of the first microprocessor 131 and outputs the modulated current. In other words, the inverter 135 outputs a driving current supplied to the circulation motor 141*a* or the drainage motor 151*a*.

The inverter 135 includes an a-phase output terminal OUTa, a b-phase output terminal OUTb, and a c-phase output terminal OUTc, as illustrated in FIG. 9, and the three output terminals OUTa, OUTb, and OUTc are connected to an a-phase input terminal, a b-phase input terminal, and a c-phase input terminal INa1, INb1, and INc1 of the circulation motor 141*a* and an a-phase input terminal, a b-phase input terminal, and a c-phase input terminal INa2, INb2, and INc2 of the drainage motor 151*a* in parallel through the current distributor 136.

Also, the inverter 135 includes three upper switching circuits Q11, Q21, and Q31 disposed between the three output terminals OUTa, OUTb, and OUTc and the direct current power supply Vdd, and three lower switching circuits Q12, Q22, and Q32 disposed between the three output terminals OUTa, OUTb, and OUTc and a ground GND. The three upper switching circuits Q11, Q21, and Q31 and the three lower switching circuits Q12, Q22, and Q32 are opened/closed according to an inverter control signal Vpwm generated by the first microprocessor 131.

Also, insulated gate bipolar transistors (IGBTs) or power field effect transistors (power FETs) for blocking or conducting high-voltage large currents may be employed as a plurality of switching circuits Q12, Q22, Q32, Q11, Q21, and Q31 that constitute the inverter 135.

Also, the inverter 135 may be implemented with a separate inverter chip 135*a*, as illustrated in FIG. 8.

Although not shown, the dishwasher 1 may further include a power supply unit (not shown) that supplies a DC (Direct Current) voltage Vdd to the inverter 135. The power supply unit (not shown) may include a rectification circuit that rectifies a voltage of an alternating current power supply supplied from an external power supply and a smoothing circuit that smoothes the rectified voltage.

The current distributor 136 includes a first three-contact point switching circuit RY1, a second three-contact point switching circuit RY2, a first switching circuit Q1, a second switching circuit Q2, and a third switching circuit Q3.

The first three-contact point switching circuit RY1 causes an a-phase current output by the inverter 135 to be supplied to one of the circulation motor 141*a* and the drainage motor 151*a*, and the second three-contact point switching circuit RY2 causes a b-phase current output by the inverter 135 to be supplied to one of the circulation motor 141*a* and the drainage motor 151*a*.

For example, each of the first three-contact point switching circuit RY1 and the second three-contact point switching circuit RY2 may include a three-contact point relay.

The first switching circuit Q1 controls an operation of the first three-contact point switching circuit RY1, and the second switching circuit Q2 controls an operation of the second three-contact point switching circuit RY2.

Also, the third switching circuit Q3 controls opening/closing of the first switching circuit Q1 and the second switching circuit Q2 according to the control signals of the first microprocessor 131 and the door signals received by the first door signal receiver 134.

In detail, if the first door signal receiver 134 receives the door closing detection signals, the third switching circuit Q3 controls the first switching circuit Q1 and the second switching circuit Q2 so that the driving current may be supplied to the circulation motor 141*a* or the drainage motor 151*a* according to the control signals of the first microprocessor 131.

Also, if the first door signal receiver 134 receives the door opening detection signals, the third switching circuit Q3 controls the first switching circuit Q1 and the second switching circuit Q2 so that the driving current may be supplied to the drainage motor 151*a* regardless of the control signals of the first microprocessor 131.

A detailed operation of the current distributor 136 will be described in detail below.

The first microprocessor 131 performs a data processing operation for controlling the circulation motor 141*a* and the drainage motor 151*a* based on the program and the data stored in the first memory 132, the data received by the first communication interface 133, and the data received by the first door signal receiver 134.

In detail, the first microprocessor 131 receives the control signals of the controller 120 from the first communication interface 133 and receives the door signals (door opening detection signals or door closing detection signals) from the first door signal receiver 134.

Also, the inverter control signal Vpwm is output to the inverter 135 and a motor selection signal Vms is output to the current distributor 136 according to the control signals and the door signals.

For example, if the rotation speed data of the circulation motor 141*a* is received through the first communication interface 133, the first microprocessor 131 transmits the motor selection signal Vms that causes the driving current to be supplied to the circulation motor 141*a*, to the current distributor 136 and transmits the inverter control signal Vpwm that causes the circulation motor 141*a* to rotate according to the received rotation speed, to the inverter 135.

As an example, if the rotation speed data of the drainage motor 151*a* is received through the first communication interface 133, the first microprocessor 131 transmits the motor selection signal Vms that causes the driving current to be supplied to the drainage motor 151*a*, to the current distributor 136 and transmits the inverter control signal Vpwm that causes the drainage motor 151*a* to rotate according to the received rotation speed, to the inverter 135.

Also, if the door opening detection signals are received through the first door signal receiver 134, the first microprocessor 131 transmits the motor selection signal Vms that causes the driving current to be supplied to the drainage motor 151*a*, to the current distributor 136 and transmits the inverter control signal Vpwm that causes rotation of the drainage motor 151*a* to stop, to the inverter 135.

The first microprocessor 131 may be implemented with a separate microprocessor chip 131*a*, as illustrated in FIG. 8. However, embodiments of the present disclosure are not limited thereto. The first microprocessor 131 may be integrated with the first memory 132 and the first communication interface 133 and may also be implemented with the single system chip.

The driving current supply unit 130 controls the circulation motor 141*a* or the drainage motor 151*a* according to the control signals of the controller 120.

For example, if the rotation speed of the circulation motor 141*a* is received from the controller 120, the driving current supply unit 130 supplies the driving current to the circulation motor 141*a* so that the circulation motor 141*a* may rotate at the received rotation speed, and if the rotation speed of the drainage motor 151*a* is received from the controller 120, the driving current supply unit 130 supplies the driving current to the drainage motor 151*a* so that the drainage motor 151*a* may rotate according to the received rotation speed.

Also, if the door opening detection signals are received from the door opening detection unit 110, the driving current supply unit 130 stops driving of the circulation motor 141*a* and waits for driving of the drainage motor 151*a*.

Also, the driving current supply unit 130 may be implemented with a PCB 130*a* on which a plurality of semiconductor devices are mounted.

For example, as illustrated in FIG. 8, the driving current supply unit 130 may be implemented with the PCB 130*a* on which the microprocessor chip 131*a*, the memory chip 132*a*, the communication chip 133*a*, the photocoupler chip 134*a*, the communication port 134*b*, and the inverter chip 135*a* are mounted.

However, embodiments of the present disclosure are not limited thereto. As described above, the driving current supply unit 130 may also be implemented with a PCB on which the single system chip in which the first microprocessor 131, the first memory 132, the first communication interface 133 and the inverter 135 are integrated with each other, and the photocoupler chip 134*a* and the communication port 134*b* are mounted.

Hereinafter, an example of a circuit that constitutes the first door signal receiver 134 and the current distributor 136 and operations of the first door signal receiver 134 and the current distributor 136 will be described with reference to FIG. 9.

As illustrated in FIG. 9, three-contact point relays may be used as the first and second three-contact point switching circuits RY1 and RY2. In this case, one end of each of two coils included in two three-contact point relays may be connected to a first power supply Vcc1, and the other end thereof may be connected to the first and second switching circuits Q1 and Q2.

In this case, if the first and second switching circuits Q1 and Q2 are turned off, the supply of currents to the coils included in three-contact point relays is blocked so that the a-phase and b-phase output terminals OUTa and OUTb of the inverter 135 may be connected to the a-phase and b-phase input terminals INa2 and INb2 of the drainage motor 151*a*. In other words, if the first and second switching circuits Q1 and Q2 are turned off, the driving current may be supplied to the drainage motor 151*a*.

Also, if the first and second switching circuits Q1 and Q2 are turned on, the currents are supplied to the coils included in three-contact point relays so that the a-phase and b-phase output terminals OUTa and OUTb of the inverter 135 may be connected to the a-phase and b-phase input terminals INa1 and INb1 of the circulation motor 141*a*. In other words, if the first and second switching circuits Q1 and Q2 are turned on, the driving current may be supplied to the circulation motor 141*a*.

The first door signal receiver 134 may include the photocoupler PC1 and a pull-up resistor R1. The photocoupler PC1 and the pull-up resistor R1 may be connected between a second power supply Vcc2 and the ground GND in series.

As described above, if the door (see 11 of FIG. 3) is in a closed state, the door opening detection unit 110 may transmit the door closing detection signals, for example, detection signals at a "high" level, to the driving current supply unit 130, and if the door 11 is opened, the door opening detection unit 110 may transmit the door opening detection signals, for example, detection signals at a "low" level, to the driving current supply unit 130.

In this case, if the detection signals at the "high" level are received from the door opening detection unit 110, the photocoupler PC1 is turned on, and the first door signal receiver 134 outputs the door signals at the "low" level.

Also, if the door (see 11 of FIG. 3) is opened and the detection signals at the "low" level are received from the door opening detection unit 110, the photocoupler PC1 is turned off, and the first door signal receiver 134 outputs the door signals at the "high" level.

The door signals are transmitted to the current distributor 136 together with the first microprocessor 131.

The current distributor 136 may include the first three-contact point switching circuit RY1, the second three-contact point switching circuit RY2, the first switching circuit Q1, the second switching circuit Q2, and the third switching circuit Q3, as illustrated in FIG. 9.

The third switching circuit Q3 is connected to a pull-up resistor R2 in series and is disposed between an output terminal of the motor selection signal Vms disposed in the first microprocessor 131 and the ground GND. Also, the third switching circuit Q3 receives the door signals from the first door signal receiver 134.

If the first door signal receiver 134 outputs the door signals at the "low" level, the third switching circuit Q3 is turned off, and the motor selection signal Vms output by the first microprocessor 131 is transmitted to the first switching circuit Q1 and the second switching circuit Q2.

In other words, if the door (see 11 of FIG. 3) is closed, the first switching circuit Q1 and the second switching circuit Q2 are turned on/off according to the motor selection signal Vms output by the first microprocessor 131.

For example, during the washing operation, the first microprocessor 131 may output the motor selection signal Vms at the "high" level to drive the circulation motor 141*a*. If the first microprocessor 131 outputs the motor selection signal Vms at the "high" level, the first and second switching circuits Q1 and Q2 are turned on, and the driving current is supplied to the circulation motor 141*a*.

Also, during the drainage operation, the first microprocessor 131 may output the motor selection signal Vms at the "low" level to drive the drainage motor 151*a*. If the first microprocessor 131 outputs the motor selection signal Vms at the "low" level, the first and second switching circuits Q1 and Q2 are turned off, and the driving current is supplied to the drainage motor 151*a*.

On the other hand, if the first door signal receiver 134 outputs the door signals at the "high" level, the third switching circuit Q3 is turned on, and the control signals at the "low" level are input to the first switching circuit Q1 and the second switching circuit Q2 regardless of the motor selection signal Vms output by the first microprocessor 131. As a result, the first switching circuit Q1 and the second switching circuit Q2 are turned off regardless of the motor selection signal Vms.

In other words, if the door 11 is opened, the first switching circuit Q1 and the second switching circuit Q2 are turned off in response to a door signal Vds regardless of the motor selection signal Vms output by the first microprocessor 131, and the driving current is supplied to the drainage motor 151*a*.

As a result, if the door (see 11 of FIG. 3) of the dishwasher 1 is in the closed state, the driving current is supplied to one of the circulation motor 141*a* and the drainage motor 151*a* according to the motor selection signal Vms output by the first microprocessor 131.

In this case, if the door (see 11 of FIG. 3) of the dishwasher 1 is opened, the driving current is supplied to the drainage motor 151*a* regardless of the motor selection signal Vms of the first microprocessor 131.

Also, if the opened door (see 11 of FIG. 3) is closed again, the first switching circuit Q1 and the second switching circuit Q2 are turned on/off according to the motor selection signal Vms output by the first microprocessor 131, and the circulation motor 141*a* or the drainage motor 151*a* is driven according to the motor selection signal Vms.

For example, if, during the washing operation, the door (see 11 of FIG. 3) is closed again after the door is opened, the first microprocessor 131 outputs the motor selection signal Vms at the "high" level to drive the circulation motor 141*a*, and the current distributor 136 supplies the driving current of the inverter 135 to the circulation motor 141*a* according to the motor selection signal Vms at the "high" level.

As an example, if, during the drainage operation, the door (see 11 of FIG. 3) is closed again after the door is opened, the first microprocessor 131 outputs the motor selection signal Vms at the "low" level to drive the drainage motor 151*a*, and the current distributor 136 supplies the driving current of the inverter 135 to the drainage motor 151*a* according to the motor selection signal Vms at the "low" level.

Figure 10:
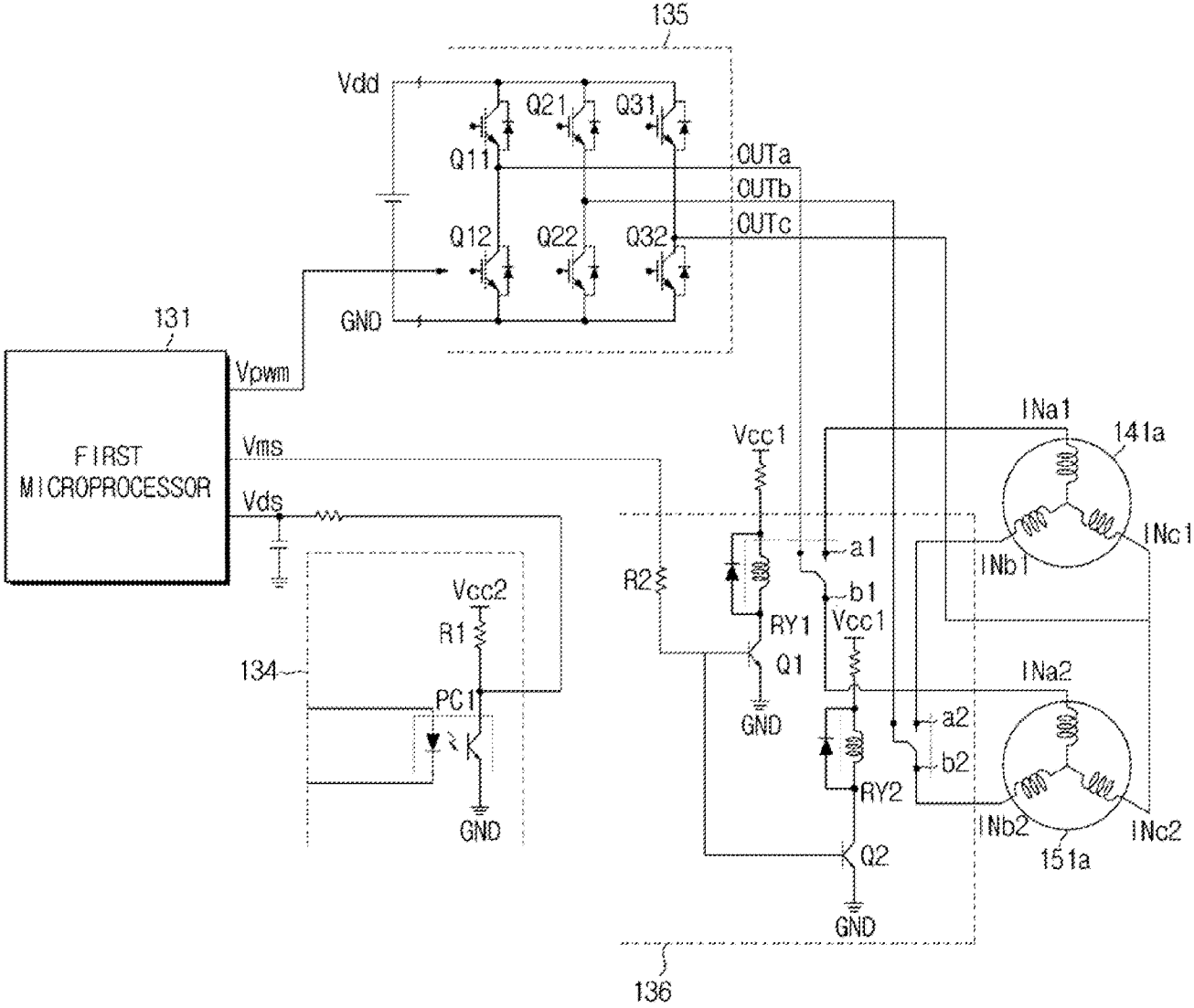
FIG. 10 is a view of an example of a circuit for implementing the driving current supply unit included in the dishwasher according to an embodiment of the present disclosure.

FIG. 10 is a view of an example of a circuit for implementing the driving current supply unit included in the dishwasher according to an embodiment of the present disclosure.

Comparing FIG. 10 with FIG. 9, the current distributor 136 illustrated in FIG. 10 does not include the third switching circuit (see Q3 of FIG. 9), and the first door signal receiver 134 transmits the door signal Vds to the first microprocessor 131.

Also, the first microprocessor 131 outputs the motor selection signal Vms according to the received door signal Vds, and the current distributor 136 causes the driving current to be supplied to one of the circulation motor 141*a* and the drainage motor 151*a* according to the motor selection signal Vms of the first microprocessor 131.

In other words, the circuit of the driving current supply unit 130 illustrated in FIG. 9 may be implemented in such a way that the first door signal receiver 134 may transmit the door signal Vds directly to the current distributor 136 and the current distributor 136 may operate according to the door signal Vds of the first door signal receiver 134. As a result, the circuit of the driving current supply unit 130 of FIG. 9 may be implemented in such a way that the supply of the driving current to the circulation motor 141*a* is stopped once the door is opened and the driving current may be supplied to the drainage motor 151*a*.

On the other hand, the circuit of the driving current supply unit 130 illustrated in FIG. 10 may be implemented in such a way that the first door signal receiver 134 may transmit the door signal Vds to the first microprocessor 131 and the current distributor 136 may operate according to the motor selection signal Vms of the first microprocessor 131. As a result, the circuit of the driving current supply unit 130 of FIG. 10 may be implemented in such a way that, if the door is opened, the first microprocessor 131 of the driving current supply unit 130 may immediately recognize that the door is opened, the supply of the driving current to the circulation motor 141*a* may be stopped without malfunction and the driving current may be supplied to the drainage motor 151*a*.

Figure 11:
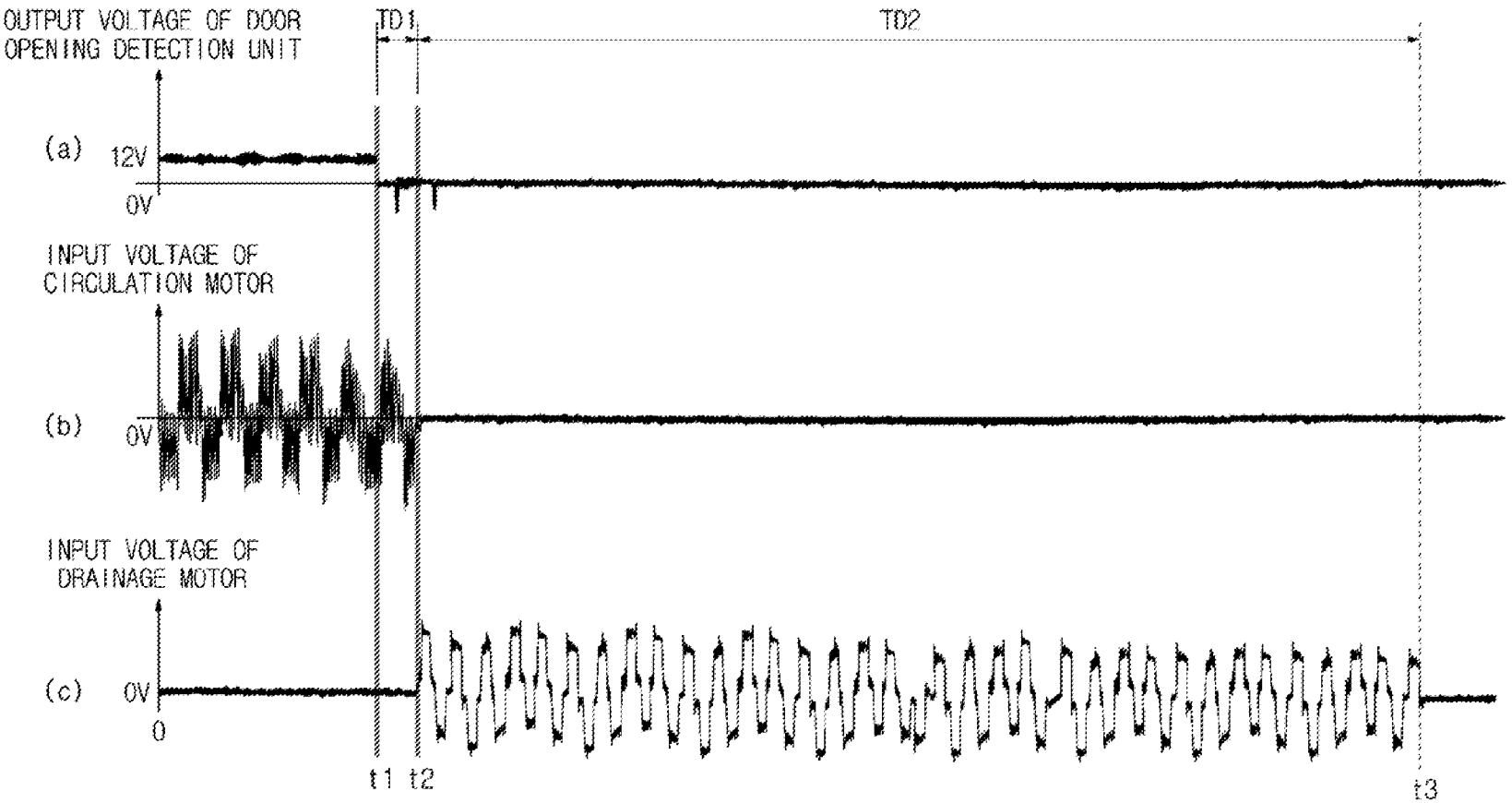
FIG. 11 is a view of an output voltage of a door opening detection unit, a driving voltage supplied to a circulation motor, and a driving voltage supplied to a drainage motor when a door included in the dishwasher according to an embodiment of the present disclosure is opened.

FIG. 11 is a view of an output voltage of a door opening detection unit, a driving voltage supplied to a circulation motor, and a driving voltage supplied to a drainage motor when a door included in the dishwasher according to an embodiment of the present disclosure is opened.

The dishwasher 1 according to an embodiment of the present disclosure transmits an output of the door opening detection unit 110 to the controller 120 and the driving current supply unit 130, as described above.

As a result, the controller 120 that controls the overall operation of the dishwasher 1 may control an operation of each of the configurations of the dishwasher 1 according to the detection result of the door opening detection unit 110, and the driving current supply unit 130 that drives the circulation motor 141*a* and the drainage motor 151*a* may stop driving of the circulation motor 141*a* and may wait for driving of the drainage motor 151*a* according to the detection result of the door opening detection unit 110.

For example, when, during the washing operation, the door (see 11 of FIG. 3) is closed, the door opening detection unit 110 outputs door closing detection signals (detection signals at a "high" level), and a driving voltage caused by the inverter 135 is supplied to the circulation motor 141*a*, as illustrated in FIG. 11.

If, during the washing operation, the door (see 11 of FIG. 3) is opened at a first time t1, the door opening detection unit 110 immediately outputs door opening detection signals (detection signals at a "low" level), and the output door opening detection signals are transmitted to the controller 120 and the driving current supply unit 130.

The driving current supply unit 130 that receives the door opening detection signals blocks connection between the inverter 135 and the circulation motor 141*a* and connects between the inverter 135 and the drainage motor 151*a*. In detail, if the door opening detection signals are received, the current distributor 136 forcibly transmits a driving voltage output by the inverter 135 to the drainage motor 151*a*.

As a result, the supply of the driving voltage to the circulation motor 141*a* is stopped at a second time t2, and the driving voltage is supplied to the drainage motor 151*a* from the second time t2, as illustrated in FIG. 11.

Also, the controller 120 that receives the door opening detection signals transmits driving stopping signals for stopping driving of the circulation motor 141*a* to the driving current supply unit 130 through communication.

According to FIG. 11, the driving current supply unit 130 blocks connection between the inverter 135 and the circulation motor 141*a* within a first time duration TD1 after the door opening detection signals are generated, and connects the inverter 135 and the drainage motor 151*a*.

In detail, the current distributor 136 blocks a connection between the inverter 135 and the circulation motor 141*a* during the first time duration TD1 and connects the inverter 135 and the drainage motor 151*a*.

Here, the first time duration TD1 is a time that the current distributor 136 blocks connection between the inverter 135 and the circulation motor 141*a* and connects between the inverter 135 and the drainage motor 151*a* according to the door opening detection signals and corresponds to several ms (millisecond).

Subsequently, the driving current is supplied to the drainage motor 151*a* until the driving stopping signals of the controller 120 are received, and the drainage motor 151*a* is driven.

Also, the supply of the driving current to the circulation motor 141*a* or the drainage motor 151*a* is stopped by the driving stopping signals at a third time t3 that a second time duration TD2 elapses after the driving current is supplied to the drainage motor 151*a*, and the drainage motor 151*a* waits for driving.

Here, the driving voltage is supplied to the drainage motor 151*a* by the operation of the inverter 135 between the second time t2 that the driving current supply unit 130 stops driving of the circulation motor 141*a* and stops the washing operation according to the driving stopping signals of the controller 120 after the drainage motor 151*a* is driven and the third time t3, and the drainage operation may be performed.

Here, the second time duration TD2 is a time that the controller 120 receives the door opening detection signals and transmits the driving stopping signals to the driving current supply unit 130 and the driving current supply unit 130 stops the operation of the inverter 135 according to the driving stopping signals and corresponds to several hundreds of ms (millisecond).

Referring to FIG. 11, the first time duration TD1 is required until the driving current supply unit 130 that detects the door opening detection signals blocks the supply of the driving voltage directly to the circulation motor 141*a* and supplies the driving voltage to the drainage motor 151*a*.

On the other hand, a time (TD1+TD2) obtained by adding the first time duration TD1 and the second time duration TD2 is required until the controller 120 that detects the door opening detection signals outputs the driving stopping signals and the driving current supply unit 130 stops the supply of the driving voltage to the circulation motor 141*a* or the drainage motor 151*a* according to the driving stopping signals.

As described above, the first time duration TD1 corresponds to several ms, and the second time duration TD2 corresponds to several hundreds of ms. Thus, an operation of directly receiving the door opening detection signals, stopping driving of the circulation motor 141*a* and preparing to drive the drainage motor 151*a* using the driving current supply unit 130 is remarkably quickly performed compared to an operation of stopping the operation of the inverter 135 according to the driving stopping signals of the controller 120 using the driving current supply unit 130.

In this way, if the door (see 11 of FIG. 3) is opened, the dishwasher 1 according to an embodiment of the present disclosure may stop driving of the circulation motor 141*a* using the driving current supply unit 130 immediately after the door is opened. As a result, the washing water sprayed by the washing unit 140 may be prevented from spattering toward the user.

As described above, the configuration of the dishwasher according to an embodiment of the present disclosure has been described.

Hereinafter, a configuration of a dishwasher according to an embodiment of the present disclosure will be described.

Figure 12:
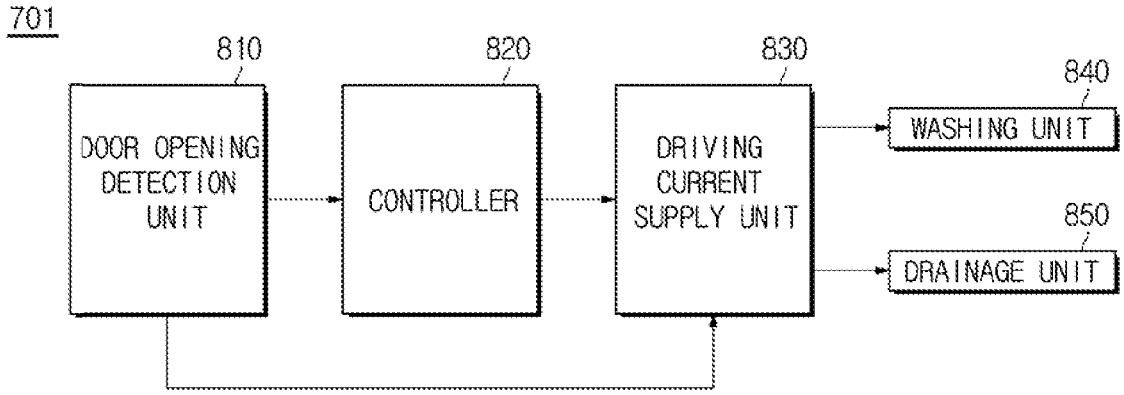
FIG. 12 is a schematic view of a configuration of a dishwasher according to an embodiment of the present disclosure.

FIG. 12 is a schematic view of a configuration of a dishwasher according to an embodiment of the present disclosure.

The configuration of a dishwasher 701 according to an embodiment of the present disclosure will be briefly described with reference to FIG. 12.

The configuration of the dishwasher 701 will now be described. The dishwasher 701 includes a door opening detection unit 810 that detects whether a door is opened, a washing unit 840 that washes dishes accommodated in the dishwasher 701, a drainage unit 850 that discharges washing water to the outside of the dishwasher 701, a driving current supply unit 830 that supplies driving energy to one of the washing unit 840 and the drainage unit 850, and a controller 820 that controls the driving current supply unit 830 so that the washing unit 840 or the drainage unit 850 may operate depending on whether the door is opened.

The washing unit 840 washes the dishes accommodated in the dishwasher 701 by circulating the washing water stored in the dishwasher 701.

If washing of the dishes using the washing unit 840 is finished, the drainage unit 850 discharges the washing water stored in the dishwasher 701 to the outside of the dishwasher 701.

The door opening detection unit 810 detects whether the door is opened, and if opening of the door is detected, the door opening detection unit 810 transmits door opening detection signals corresponding to door opening to the controller 820 and the driving current supply unit 830.

In detail, if the door of the dishwasher 701 is closed, the door opening detection unit 810 outputs door closing detection signals, and if the door of the dishwasher 701 is opened, the door opening detection unit 810 outputs the door opening detection signals.

The controller 820 controls the driving current supply unit 830 so that one of the washing unit 840 and the drainage unit 850 may operate according to the door opening detection signals of the door opening detection unit 810. In detail, if the door opening detection signals are received, the controller 820 transmits control signals that cause the washing unit 840 to stop an operation and the drainage unit 850 to wait for an operation, to the driving current supply unit 830.

The driving current supply unit 830 supplies the driving energy to one of the washing unit 840 and the drainage unit 850 according to the control signals of the controller 820 and the door opening detection signals of the door opening detection unit 810.

In particular, if the door opening detection signals are received from the door opening detection unit 810, the driving current supply unit 830 stops supplying of the driving energy to the washing unit 840 and prepares to supply the driving energy to the drainage unit 850.

The operation of the dishwasher 701 will now be briefly described. The dishwasher 701 performs a washing operation of washing the dishes and a rinsing operation of rinsing the dishes. Also, the dishwasher 701 may optionally further perform a drying operation of drying the dishes.

Each of the washing operation and the rinsing operation includes a water supplying operation of supplying washing water used to wash the dishes, a spraying operation of spraying the washing water toward the dishes, and a drainage operation of discharging the washing water after dish washing is finished.

During the water supplying operation, the dishwasher 701 receives the washing water from an external water supply source through a water supplying unit (not shown). During the spraying operation, the dishwasher 701 sprays the washing water toward the dishes through the washing unit 840. Also, during the drainage operation, the dishwasher 701 discharges the washing water stored in the dishwasher 701 through the drainage unit 850.

In particular, when the user opens the door of the dishwasher 701 during the spraying operation, the dishwasher 701 stops the operation of the washing unit 840 so that the washing water sprayed by the washing unit 840 may not spatter toward the user. Also, the dishwasher 701 waits for the operation of the drainage unit 850 so that the washing water stored in the dishwasher 701 may not overflow to the outside of the dishwasher 701 through the door.

Figure 13:
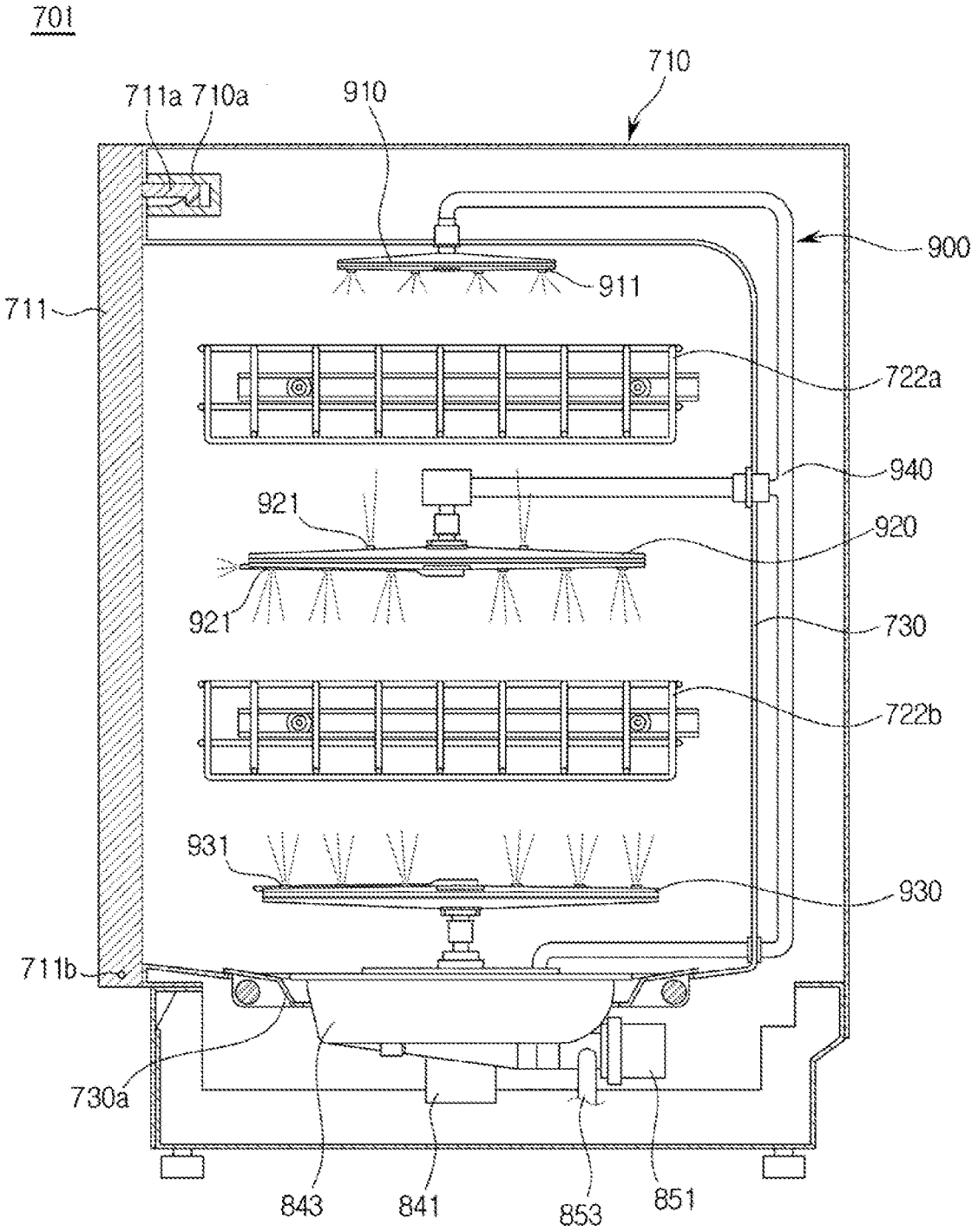
FIG. 13 is a side cross-sectional view of the dishwasher according to an embodiment of the present disclosure.
Figure 14:
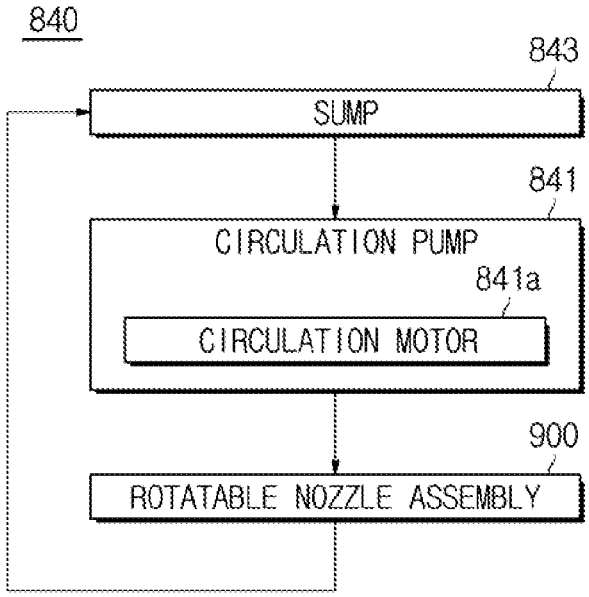
FIG. 14 is a view of a circulation operation of washing water using a washing unit included in the dishwasher according to an embodiment of the present disclosure.
Figure 15:
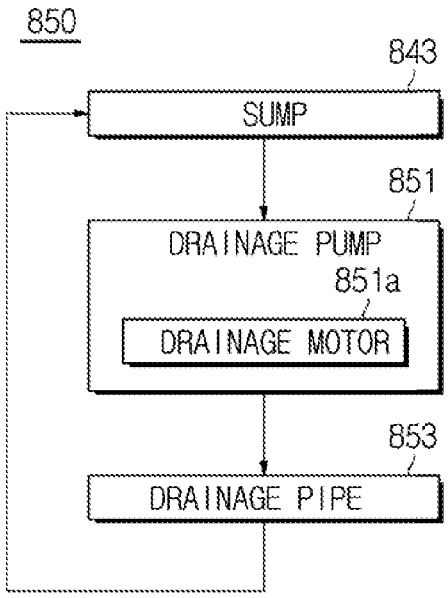
FIG. 15 is a view of a discharging operation of the washing water using a drainage unit included in the dishwasher according to an embodiment of the present disclosure.

FIG. 13 is a side cross-sectional view of the dishwasher according to an embodiment of the present disclosure, and FIG. 14 is a view of a circulation operation of the washing water using a washing unit included in the dishwasher according to an embodiment of the present disclosure, and FIG. 15 is a view of a discharging operation of the washing water using a drainage unit included in the dishwasher according to an embodiment of the present disclosure.

Referring to FIGS. 13 through 15, the dishwasher 701 according to an embodiment of the present disclosure includes a cabinet 710, a front side of which is opened, and a door 711 that opens/closes the front side of the cabinet 710.

A hinge 711*b* that causes the door 711 to be rotatably coupled to the cabinet 710, is disposed at one side of the door 711, and a hook 711*a* for fixing the door 711 into the cabinet 710 is disposed at the other side of the door 711.

Also, a latch 710*a* coupled to the hook 711*a* in a position corresponding to the hook 711*a* of the door 711 is disposed in the cabinet 710.

By using the hinge 711*b*, the door 711 may be rotatably coupled to one side of the cabinet 710. The door 711 may close or open the front side of the cabinet 710.

Also, when the door 711 closes the front side of the cabinet 710, the hook 711*a* of the door 711 is inserted into the latch 710*a* of the cabinet 710, and the hook 711*a* is caught in a hanging portion disposed in the latch 710*a* so that the door 711 may be fixed into the cabinet 710. In other words, the door 711 is closed.

A tub 730 in which washing of the dishes is performed, is disposed in the cabinet 710, and baskets 722*a* and 722*b* for accommodating the dishes, the washing unit 840 that washes the dishes by spraying the washing water toward the dishes, and the drainage unit 850 that discharges the washing water if washing is finished, are disposed in the tub 730.

The tub 730 may have a shape of a box, the front of which is opened so that the dishes may be put into/taken out of the tub 730. Also, the front of the tub 730 may be opened/closed by the above-described door 711, and the tub 730 may include a bottom plate 730*a*.

The baskets 722*a* and 722*b* may be wire racks configured of wires so that the washing water may not be collected therein but may pass through the baskets 722*a* and 722*b*. Also, the baskets 722*a* and 722*b* may be disposed to be attached to/detached from the tub 730.

The baskets 722*a* and 722*b* may include an upper basket 722*a* disposed at an upper portion of the tub 730 and a lower basket 722*b* disposed at a lower portion of the tub 730.

The washing unit 840 includes a rotatable nozzle assembly 900 that sprays the washing water, a sump 843 that stores the sprayed washing water, and a circulation pump 841 that pumps the stored washing water toward the rotatable nozzle assembly 900.

The rotatable nozzle assembly 900 may wash the dishes by spraying the washing water under a high pressure. The rotatable nozzle assembly 900 includes an upper rotatable nozzle 910 disposed at an upper portion of the tub 730, an intermediate rotatable nozzle 920 disposed in the center of the tub 730, and a lower rotatable nozzle 930 disposed at a lower portion of the tub 730.

The rotatable nozzle assembly 900 receives the washing water through a central supply flow path 940 and sprays the washing water through rotatable spray holes 911, 921, and 931 formed in the upper rotatable nozzle 910, the intermediate rotatable nozzle 920, and the lower rotatable nozzle 930, respectively.

Also, the rotatable nozzle assembly 900 may rotate due to a reaction caused by spraying of the washing water.

The sump 843 is disposed on the bottom plate 730*a* of the tub 730 and stores the washing water sprayed by the rotatable nozzle assembly 900.

The circulation pump 841 includes a circulation motor 841*a* for pumping the washing water to the rotatable nozzle assembly 900.

A brushless direct current motor or a synchronous motor, a rotation speed of which may be controlled, may be used as the circulation motor 841*a* so that the rotatable nozzle assembly 900 may spray the washing water using various washing water spray forces.

Although it will be described later, the above-described driving current supply unit 830 may include an inverter to control the rotation speed of the brushless direct current motor or the synchronous motor.

The circulation of the washing water using the washing unit 840 will be briefly described. First, the sump 843 stores the washing water supplied by the water supplying unit (not shown).

During the washing operation, the circulation pump 841 pumps the washing water stored in the sump 843 to the rotatable nozzle assembly 900 using the rotational force generated by the circulation motor 841*a*.

The washing water distributed to the rotatable nozzle assembly 900 is sprayed toward the dishes through the rotatable spray holes 911, 921, and 931 and is used to wash the dishes. After the dishes are washed, the washing water is stored again in the sump 843.

In this way, the washing water is used to wash the dishes by circulating the sump 843, the circulation pump 841, and the rotatable nozzle assembly 900.

The drainage unit 850 includes a drainage pump 851 that pumps the washing water stored in the sump 843 to the outside of the dishwasher 701, and a drainage pipe 853 that guides the washing water pumped by the drainage pump 851 toward the outside of the dishwasher 701.

The drainage pump 851 includes a drainage motor 851*a* for pumping the washing water to the outside of the dishwasher 701 through the drainage pipe 853.

A brushless direct current motor or a synchronous motor may be used as the drainage motor 851*a* to reduce noise that occurs when the drainage motor 851*a* operates.

Discharging of the washing water using the drainage unit 850 will now be briefly described. First, the sump 843 stores the washing water sprayed by the rotatable nozzle assembly 900.

If the washing operation is finished, the drainage pump 851 pumps the washing water stored in the sump 843 to the drainage pipe 853 using the rotational force generated by the drainage motor 851*a*.

The washing water pumped by the drainage pump 851 is discharged to the outside of the dishwasher 701 along the drainage pipe 853.

Figure 16:
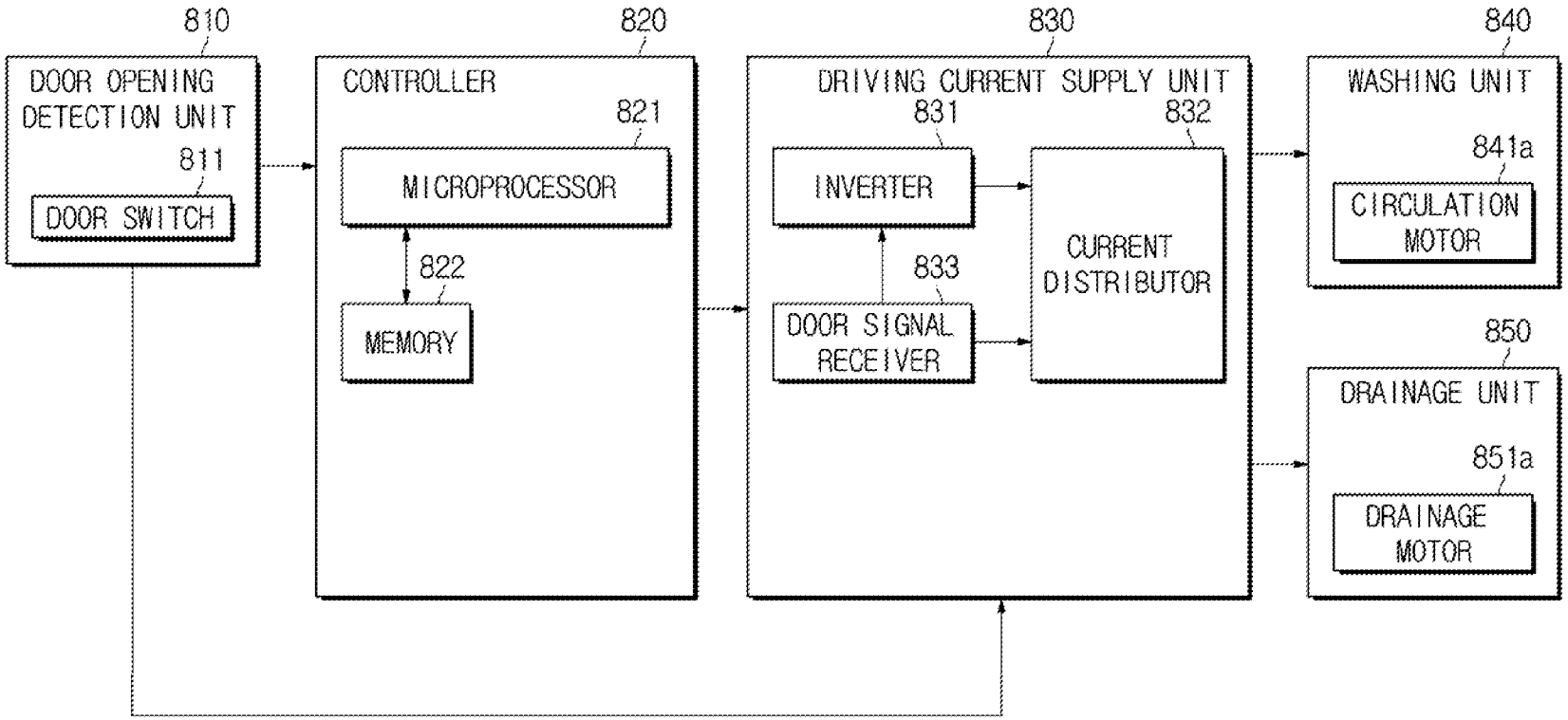
FIG. 16 is a view of a configuration of a controller and a driving current supply unit included in the dishwasher according to an embodiment of the present disclosure.
Figure 17:
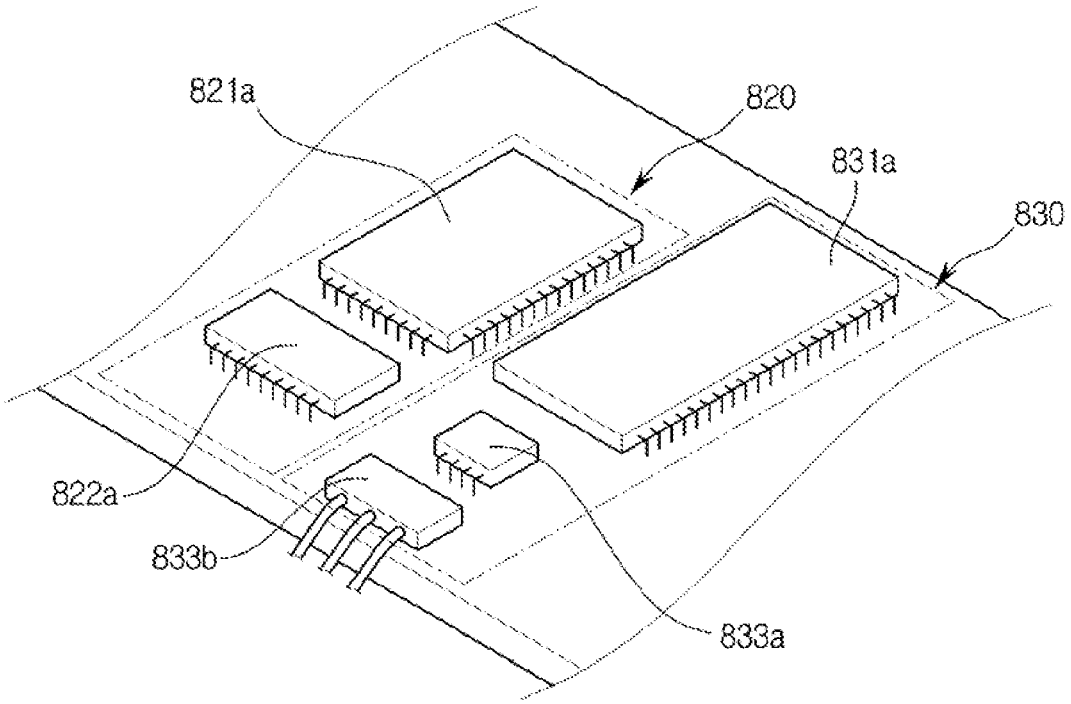
FIG. 17 is a view of an implementation example of the controller and the driving current supply unit included in the dishwasher according to an embodiment of the present disclosure.
Figure 18:
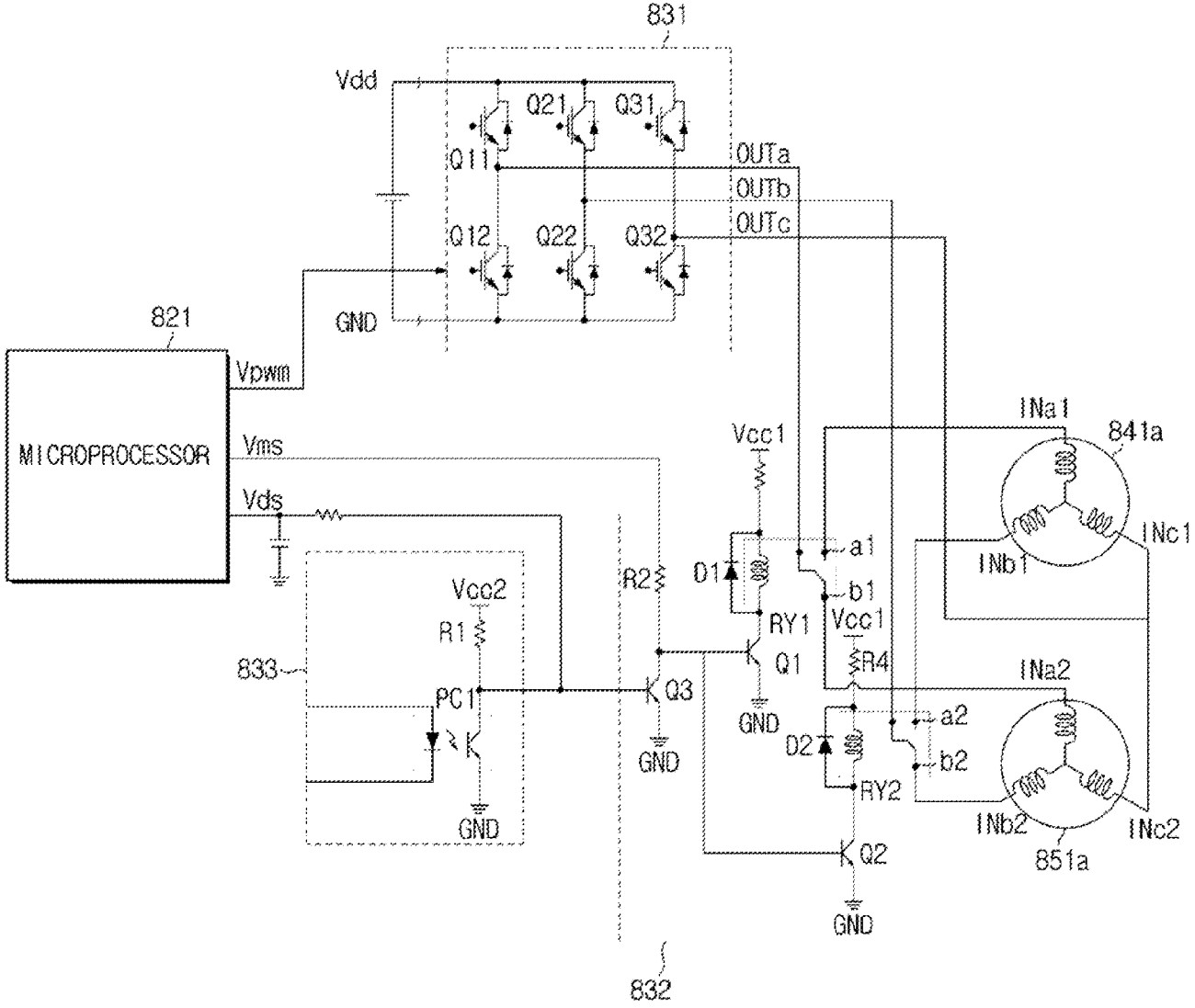
FIG. 18 is a view of an example of a circuit for implementing the driving current supply unit included in the dishwasher according to an embodiment of the present disclosure.

FIG. 16 is a view of a configuration of a controller and a driving current supply unit included in the dishwasher according to an embodiment of the present disclosure, FIG. 17 is a view of an implementation example of the controller and the driving current supply unit included in the dishwasher according to an embodiment of the present disclosure, and FIG. 18 is a view of an example of a circuit for implementing the driving current supply unit included in the dishwasher according to an embodiment of the present disclosure.

As described above, the dishwasher 701 includes the door opening detection unit 810 that detects whether the door (see 711 of FIG. 13) is opened, the controller 820 that controls an overall operation of the dishwasher 701, the driving current supply unit 830 that supplies driving energy to the washing unit 840 and the drainage unit 850, the washing unit 840 that washes the dishes by spraying the washing water, and the drainage unit 850 that discharges the washing water if dish washing is finished.

The washing unit 840 and the drainage unit 850 have been already described and thus, a detailed description thereof will be omitted.

The door opening detection unit 810 includes a door switch 811.

For example, the door switch 811 may be disposed in the latch (see 710*a* of FIG. 13) of the cabinet (see 710 of FIG. 13) and outputs different electrical signals depending on whether the door (see 711 of FIG. 13) is opened/closed.

For example, if the door 711 is closed, the door switch 811 may output detection signals at a "high" level, for example, voltage signals of 12 V, and if the door 711 is opened, the door switch 811 may output detection signals at a "low" level, for example, voltage signals of 0 V.

Also, the voltage signals output by the door switch 811 are transmitted to the driving current supply unit 830.

If the door 711 is closed, the door opening detection unit 810 may output door closing detection signals, for example, detection signals at a "high" level, and if the door 711 is opened, the door opening detection unit 810 may output door opening detection signals, for example, detection signals at a "low" level.

The driving current supply unit 830 includes a door signal receiver 833, an inverter 831, and a current distributor 832.

The door signal receiver 833 receives the door closing detection signals and the door opening detection signals transmitted by the door opening detection unit 810.

In detail, the door signal receiver 833 receives the door closing detection signals and the door opening detection signals transmitted by the door opening detection unit 810, restores data from the received door closing detection signals and door opening detection signals, and transmits the restored data to a microprocessor 821.

For example, the door signal receiver 833 may include a photocoupler for restoring the door detection signals transmitted by the door opening detection unit 810 into the data that may be identified by the microprocessor 821.

Also, the door signal receiver 833 may be implemented with a separate photocoupler chip 833*a* and a separate communication port 833*b*, as illustrated in FIG. 17.

The inverter 831 modulates a current of a direct current power supply Vdd according to the control signals of the microprocessor 821 and outputs the modulated current. In other words, the inverter 831 outputs a driving current supplied to the circulation motor 841*a* or the drainage motor 851*a*.

The inverter 831 includes an a-phase output terminal OUTa, a b-phase output terminal OUTb, and a c-phase output terminal OUTc, as illustrated in FIG. 18, and the three output terminals OUTa, OUTb, and OUTc are connected to an a-phase input terminal, a b-phase input terminal, and a c-phase input terminal INa1, INb1, and INc1 of the circulation motor 841*a* and an a-phase input terminal, a b-phase input terminal, and a c-phase input terminal INa2, INb2, and INc2 of the drainage motor 851*a* in parallel through the current distributor 832.

Also, the inverter 831 includes three upper switching circuits Q11, Q21, and Q31 disposed between the three output terminals OUTa, OUTb, and OUTc and the direct current power supply Vdd, and three lower switching circuits Q12, Q22, and Q32 disposed between the three output terminals OUTa, OUTb, and OUTc and a ground GND. The three upper switching circuits Q11, Q21, and Q31 and the three lower switching circuits Q12, Q22, and Q32 are opened/closed according to an inverter control signal Vpwm generated by the first microprocessor 821.

Also, IGBTs or power FETs for blocking or conducting high-voltage large currents may be employed as a plurality of switching circuits Q12, Q22, Q32, Q11, Q21, and Q31 that constitute the inverter 831.

Also, the inverter 831 may be implemented with a separate inverter chip 831*a*, as illustrated in FIG. 17.

Although not shown, the dishwasher 701 may further include a power supply unit (not shown) that supplies a DC (Direct Current) voltage Vdd to the inverter 831. The power supply unit (not shown) may include a rectification circuit that rectifies a voltage of an alternating current power supply supplied from an external power supply and a smoothing circuit that smoothes the rectified voltage.

The current distributor 832 includes a first three-contact point switching circuit RY1, a second three-contact point switching circuit RY2, a first switching circuit Q1, a second switching circuit Q2, and a third switching circuit Q3.

The first three-contact point switching circuit RY1 causes an a-phase current output by the inverter 831 to be supplied to one of the circulation motor 841*a* and the drainage motor 851*a*, and the second three-contact point switching circuit RY2 causes a b-phase current output by the inverter 831 to be supplied to one of the circulation motor 841*a* and the drainage motor 851*a*.

For example, each of the first three-contact point switching circuit RY1 and the second three-contact point switching circuit RY2 may include a three-contact point relay.

The first switching circuit Q1 controls an operation of the first three-contact point switching circuit RY1, and the second switching circuit Q2 controls an operation of the second three-contact point switching circuit RY2.

Also, the third switching circuit Q3 controls opening/closing of the first switching circuit Q1 and the second switching circuit Q2 according to the control signals of the microprocessor 821 and the door signals received by the door signal receiver 833.

In detail, if the door signal receiver 833 receives the door closing detection signals, the third switching circuit Q3 controls the first switching circuit Q1 and the second switching circuit Q2 so that the driving current may be supplied to the circulation motor 841*a* or the drainage motor 851*a* according to the control signals of the microprocessor 821.

Also, if the door signal receiver 833 receives the door opening detection signals, the third switching circuit Q3 controls the first switching circuit Q1 and the second switching circuit Q2 so that the driving current may be supplied to the drainage motor 851*a* regardless of the control signals of the first microprocessor 821.

A detailed operation of the current distributor 832 will be described in detail below.

The controller 820 includes a memory 822 and a microprocessor 821.

The memory 822 stores a program and data for controlling the operation of the dishwasher 701, in particular, an operation of the circulation motor 841*a* of the washing unit 840 and an operation of the drainage motor 851*a* of the drainage unit 850 and temporary data that is generated during the operation of the dishwasher 701.

In detail, the memory 822 may include a nonvolatile memory, such as a ROM, an EPROM, an EEPROM, or a flash memory for permanently storing the program and the data for controlling the operation of the dishwasher 701, and a volatile memory, such as a DRAM or an SRAM for temporarily storing data that is generated while the operation of the dishwasher 701 is controlled.

The memory 822 may be implemented with a separate memory chip 822*a*, as illustrated in FIG. 17. However, embodiments of the present disclosure are not limited thereto. The memory 822 may be integrated with the microprocessor 821 and may also be implemented with an SOC.

The microprocessor 821 performs a data processing operation for controlling the configuration included in the dishwasher 701, in particular, the circulation motor 841*a* and the drainage motor 851*a* based on the user's control instructions, the program and the data stored in the memory 822.

In detail, the microprocessor 821 receives door signals (door opening detection signals or door closing detection signals) from the door signal receiver 833.

Also, the microprocessor 821 outputs the inverter control signal Vpwm to the inverter 831 and outputs a motor selection signal Vms to the current distributor 832.

For example, if the user's control instructions are input to the microprocessor 821, the microprocessor 821 transmits the motor selection signal Vms that causes the driving current to be supplied to the circulation motor 841*a*, to the current distributor 832 and transmits the inverter control signal Vpwm that causes the circulation motor 841*a* to rotate according to received rotation speed, to the inverter 831.

As an example, if the washing operation is finished, the microprocessor 821 transmits the motor selection signal Vms that causes the driving current to be supplied to the drainage motor 851*a*, to the current distributor 832 and transmits the inverter control signal Vpwm that causes the drainage motor 851*a* to rotate according to the received rotation speed, to the inverter 831.

Also, if the door opening detection signals are received through the door signal receiver 833, the microprocessor 821 may transmit the motor selection signal Vms that causes the driving current to be supplied to the drainage motor 851*a*, to the current distributor 832 and may transmit the inverter control signal Vpwm that causes rotation of the drainage motor 851*a* to be stopped, to the inverter 831.

The microprocessor 821 may be implemented with a separate microprocessor chip 821*a*, as illustrated in FIG. 17. However, embodiments of the present disclosure are not limited thereto. The microprocessor 821 may be integrated with the memory 822 and may also be implemented with a single system chip.

In this way, the controller 820 controls the driving current supply unit 830 so that the circulation motor 841*a* or the drainage motor 851*a* may operate according to the user's control instructions, and the driving current supply unit 830 optionally supplies the driving current to the circulation motor 841*a* and the drainage motor 851*a* according to the control signals of the controller 820.

For example, if the washing operation starts being performed, the controller 820 transmits the control signals to the driving current supply unit 830 so that the washing unit 840 may spray the washing water toward the dishes, and the driving current supply unit 830 supplies the driving current to the circulation motor 841*a* so that the circulation motor 841*a* may rotate.

If the washing operation is finished, the controller 820 transmits the control signals to the driving current supply unit 830 so that the drainage unit 850 may discharge the washing water, and the driving current supply unit 830 supplies the driving current to the drainage motor 851*a* so that the drainage motor 851*a* may rotate.

If, during the spraying operation, the door opening detection signals are received from the door opening detection unit 810, the controller 820 transmits the control signals to the driving current supply unit 830 so that the washing unit 840 may stop spraying of the washing water and the drainage unit 850 may wait for discharging of the washing water, and the driving current supply unit 830 stops driving of the circulation motor 841*a* and waits for driving of the drainage motor 851*a*.

Hereinafter, an example of a circuit that constitutes the door signal receiver 833 and the current distributor 832 and operations of the door signal receiver 833 and the current distributor 832 will be described with reference to FIG. 18.

As illustrated in FIG. 18, the first and second three-contact point switching circuits RY1 and RY2 may employ three-contact point relays. In this case, a first power supply Vcc1 may be connected to one of each of two coils included in two three-contact point relays, and the first and second switching circuits Q1 and Q2 may be connected to the other end thereof.

In this case, if the first and second switching circuits Q1 and Q2 are turned off, the supply of currents to the coils included in the three-contact point relays is blocked so that the a-phase and b-phase output terminals OUTa and OUTb of the inverter 831 may be connected to the a-phase and b-phase input terminals INa2 and INb2 of the drainage motor 851*a*. In other words, if the first and second switching circuits Q1 and Q2 are turned off, the driving current may be supplied to the drainage motor 851*a*.

Also, if the first and second switching circuits Q1 and Q2 are turned on, the currents are supplied to the coils included in the three-contact point relays so that the a-phase and b-phase output terminals OUTa and OUTb of the inverter 831 may be connected to the a-phase and b-phase input terminals INa1 and INb1 of the circulation motor 841*a*. In other words, if the first and second switching circuits Q1 and Q2 are turned on, the driving current may be supplied to the circulation motor 841*a*.

The door signal receiver 833 may include a photocoupler PC1 and a pull-up resistor R1. The photocoupler PC1 and the pull-up resistor R1 may be connected between a second power supply Vcc2 and a ground GND in series.

As described above, if the door (see 711 of FIG. 13) is closed, the door opening detection unit 810 may transmit the door closing detection signals, for example, detection signals at a "high" level, to the driving current supply unit 830, and if the door 711 is opened, the door opening detection unit 810 may transmit the door opening detection signals, for example, detection signals at a "low" level, to the driving current supply unit 830.

In this case, if the detection signals at the "high" level are received from the door opening detection unit 810, the photocoupler PC1 is turned on, and the door signal receiver 833 outputs the door signals at the "low" level.

Also, if the door (see 711 of FIG. 13) is opened and the detection signals at the "low" level are received from the door opening detection unit 810, the photocoupler PC1 is turned off, and the door signal receiver 833 outputs the door signals at the "high" level.

The door signals are transmitted to the current distributor 832 together with the microprocessor 821.

The current distributor 832 may include the first three-contact point switching circuit RY1, the second three-contact point switching circuit RY2, the first switching circuit Q1, the second switching circuit Q2, and the third switching circuit Q3, as illustrated in FIG. 18.

The third switching circuit Q3 is connected to a pull-up resistor R2 in series and is disposed between an output terminal of the motor selection signal Vms disposed in the microprocessor 821 and the ground GND. Also, the third switching circuit Q3 receives the door signals from the door signal receiver 833.

If the door signal receiver 833 outputs the door signals at the "low" level, the third switching circuit Q3 is turned off, and the motor selection signal Vms output by the microprocessor 821 is transmitted to the first switching circuit Q1 and the second switching circuit Q2.

In other words, if the door (see 711 of FIG. 13) is closed, the first switching circuit Q1 and the second switching circuit Q2 are turned on/off according to the motor selection signal Vms output by the microprocessor 821.

For example, during the washing operation, the microprocessor 821 may output the motor selection signal Vms at the "high" level to drive the circulation motor 841*a*. If the microprocessor 821 outputs the motor selection signal Vms at the "high" level, the first and second switching circuits Q1 and Q2 are turned on, and the driving current is supplied to the circulation motor 841*a*.

Also, during the drainage operation, the microprocessor 821 may output the motor selection signal Vms at the "low" level to drive the drainage motor 851*a*. If the microprocessor 821 outputs the motor selection signal Vms at the "low" level, the first and second switching circuits Q1 and Q2 are turned off, and the driving current is supplied to the drainage motor 851*a*.

On the other hand, if the door signal receiver 833 outputs the door signals at the "high" level, the third switching circuit Q3 is turned on, and the control signals at the "low" level are input to the first switching circuit Q1 and the second switching circuit Q2 regardless of the motor selection signal Vms output by the microprocessor 821. As a result, the first switching circuit Q1 and the second switching circuit Q2 are turned off regardless of the motor selection signal Vms.

In other words, if the door 711 is opened, the first switching circuit Q1 and the second switching circuit Q2 are turned off in response to a door signal Vds regardless of the motor selection signal Vms output by the microprocessor 821, and the driving current is supplied to the drainage motor 851*a*.

As a result, if the door (see 711 of FIG. 13) of the dishwasher 701 is closed, the driving current is supplied to one of the circulation motor 841*a* and the drainage motor 851*a* according to the motor selection signal Vms output by the microprocessor 821. If the door (see 711 of FIG. 13) of the dishwasher 701 is opened, the driving current is supplied to the drainage motor 851*a* regardless of the motor selection signal Vms of the microprocessor 821.

Also, if the opened door (see 711 of FIG. 13) is closed again, the first switching circuit Q1 and the second switching circuit Q2 are turned on/off according to the motor selection signal Vms output by the microprocessor 821, and the circulation motor 841*a* or the drainage motor 851*a* is driven according to the motor selection signal Vms.

For example, if, during the washing operation, the door (see 711 of FIG. 13) is closed again after the door is opened, the microprocessor 821 outputs the motor selection signal Vms at the "high" level to drive the circulation motor 841*a*, and the current distributor 832 supplies the driving current of the inverter 831 to the circulation motor 841*a* according to the motor selection signal Vms at the "high" level.

As an example, if, during the drainage operation, the door (see 711 of FIG. 13) is closed again after the door is opened, the microprocessor 821 outputs the motor selection signal Vms at the "low" level to drive the drainage motor 851*a*, and the current distributor 832 supplies the driving current of the inverter 831 to the drainage motor 851*a* according to the motor selection signal Vms at the "low" level.

As described above, when the user opens the door of the dishwasher during the washing operation, a driving unit that drives the circulation pump and the drainage pump itself stops driving of the circulation pump so that the dishwasher that quickly stops an operation of the circulation pump and waits for an operation of the drainage pump can be provided.

The above-described embodiments may be recorded in computer-readable media including program instructions to implement various operations embodied by a computer. The media may also include, alone or in combination with the program instructions, data files, data structures, and the like. The program instructions recorded on the media may be those specially designed and constructed for the purposes of embodiments, or they may be of the kind well-known and available to those having skill in the computer software arts. Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. The computer-readable media may also be a distributed network, so that the program instructions are stored and executed in a distributed fashion. The program instructions may be executed by one or more processors. The computer-readable media may also be embodied in at least one application specific integrated circuit (ASIC) or Field Programmable Gate Array (FPGA), which executes (processes like a processor) program instructions. Examples of program instructions include both machine code, such as produced by a compiler, and files containing higher level code that may be executed by the computer using an interpreter. The above-described devices may be configured to act as one or more software modules in order to perform the operations of the above-described embodiments, or vice versa.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A dishwasher comprising:

a circulation pump that supplies water to a nozzle;

a drainage pump that discharges the water;

a driving current supplier including an inverter that outputs a driving current and a current distributor that selectively supplies the driving current to the circulation pump and the drainage pump by switching the supply of the driving current between the circulation pump and the drainage pump;

a controller that transmits a driving control signal to the driving current supplier; and a door opening detector that detects whether a door of the dishwasher is an open state or a closed state, and, when the door is detected to be open, transmits a door opening detection signal to the controller and the driving current supplier, and when the door is detected to be closed, transmits a door closing detection signal to the controller and the driving current supplier, wherein, when the door closing detection signal is received by the controller and the driving current supplier, the current distributor is controlled based on the driving control signal from the controller, wherein, when the door opening detection signal is received by the controller and the driving current supplier while the driving current is supplied to the circulation pump, the current distributor stops the supply of the driving current to the circulation pump and supplies the driving current to the drainage pump regardless of the driving control signal from the controller, so that an operation of the circulation pump is stopped from the current distributor before the inverter stops the output of the driving current, and wherein the driving current supplier further comprises a door signal receiver that receives the door opening detection signal from the door opening detector.

2. The dishwasher of claim 1, wherein the driving current supplier further comprises a microprocessor that controls the inverter and the current distributor according to the driving control signal transmitted by the controller.

3. The dishwasher of claim 2, wherein the current distributor comprises a three-contact point switching circuit that connects the inverter to one of the circulation pump and the drainage pump according to a motor selection signal output by the microprocessor.

4. The dishwasher of claim 3, wherein, when the door opening detection signal is received by the controller and the driving current supplier, the three-contact point switching circuit connects the inverter and the drainage pump.

5. The dishwasher of claim 2, wherein, when the door opening detection signal is received by the controller and the driving current supplier, the microprocessor stops an operation of the inverter.

6. The dishwasher of claim 3, wherein the three-contact point switching circuit comprises:

a three-contact point relay that connects the inverter to one of the circulation pump and the drainage pump; and a relay driving circuit that selectively blocks or supplies a current to the three-contact point relay.

7. The dishwasher of claim 6, wherein, when the current is supplied to the three-contact point relay, the inverter is connected to the circulation pump, and when the current to the three-contact point relay is blocked, the inverter is connected to the drainage pump.

8. The dishwasher of claim 6, wherein, when the door opening detection signal is received by the controller and the driving current supplier, the relay driving circuit blocks the current to the three-contact point relay.

9. The dishwasher of claim 6, wherein, when the door opening detection signal is not received by the controller and the driving current supplier, the relay driving circuit supplies the current to the three-contact point relay.

10. The dishwasher of claim 1, wherein the controller comprises a microprocessor that outputs the driving control signal to operate one of the circulation pump and the drainage pump according to a user's control instruction.

11. The dishwasher of claim 10, wherein the current distributor comprises a three-contact point switching circuit that connects the inverter to one of the circulation pump and the drainage pump according to the driving control signal output by the microprocessor.

12. The dishwasher of claim 11, wherein, when the door opening detection signal is received by the controller and the driving current supplier, the three-contact point switching circuit connects the inverter and the drainage pump.

13. The dishwasher of claim 11, wherein, when the door opening detection signal is received by the controller and the driving current supplier, the microprocessor stops an operation of the inverter.

14. The dishwasher of claim 11, wherein the three-contact point switching circuit comprises:

a three-contact point relay that connects the inverter to one of the circulation pump and the drainage pump; and a relay driving circuit that supplies a current to the three-contact point relay.

* * * * *